US005983471A

United States Patent [19]

Osawa

[11] Patent Number: 5,983,471

[45] Date of Patent: Nov. 16, 1999

[54] METHOD OF MANUFACTURING AN INK-JET HEAD

[75] Inventor: Seiichi Osawa, Tochigi, Japan

[73] Assignee: Citizen Watch Co., Ltd., Tokyo, Japan

[21] Appl. No.: 08/867,361

[22] Filed: Jun. 2, 1997

Related U.S. Application Data

[62] Division of application No. 08/619,627, Apr. 10, 1996.

[30] Foreign Application Priority Data

Oct. 14, 1993 [JP] Japan ..... 5/280371
May 25, 1994 [JP] Japan ..... 6/111312

[51] Int. Cl.[6] ..... H04R 17/00

[52] U.S. Cl. ..... 29/25.35; 347/70; 310/328

[58] Field of Search ..... 29/25.35; 347/70, 347/71, 72; 310/328, 334, 358, 359, 366, 368

[56] References Cited

U.S. PATENT DOCUMENTS

| | | | |
|---|---|---|---|
| 4,747,192 | 5/1988 | Rokurota | 29/25.35 |
| 5,072,240 | 12/1991 | Miyazawa et al. | 346/140 R |
| 5,128,694 | 7/1992 | Kanayama | 346/140 |
| 5,144,342 | 9/1992 | Kubota | 346/140 |
| 5,167,231 | 12/1992 | Matsui | 128/662.03 |
| 5,446,485 | 8/1995 | Usui et al. | 347/72 |
| 5,543,959 | 8/1996 | Jeon | 359/259 |
| 5,735,026 | 4/1998 | Min | 29/25.35 |
| 5,834,880 | 11/1998 | Venkataramani et al. | 310/334 |

FOREIGN PATENT DOCUMENTS

| | | |
|---|---|---|
| 53-12138 | 4/1978 | Japan . |
| 59-41272 | 3/1984 | Japan . |
| 61-59914 | 12/1986 | Japan . |
| 4-1052 | 1/1992 | Japan . |
| 4-41248 | 2/1992 | Japan . |
| 4-86265 | 3/1992 | Japan . |
| 4-48622 | 8/1992 | Japan . |
| 4-52213 | 8/1992 | Japan . |

OTHER PUBLICATIONS

International Search Report for International Application No. PCT/JP94/01730 dated Jan. 31, 1995.

*Primary Examiner*—Carl E. Hall
*Assistant Examiner*—Davide Caputo
*Attorney, Agent, or Firm*—Armstrong, Westerman, Hattori, McLeland & Naughton

[57] ABSTRACT

Pairs of laminated piezoelectric actuator (111) are arranged in plural rows on a base plate (110) to form a laminated piezoelectric actuator unit. A diaphragm (115) is bonded to the upper end surface of the laminated piezoelectric actuator unit, and a flow path plate (118) is bonded to the upper surface of the diaphragm (115). Here, a plurality of pressurizing chambers (116) and an ink flow path (117) are formed in the flow path plate (118) such that each pressurizing chamber (116) is disposed corresponding to each laminated piezoelectric actuator (111). Moreover, a nozzle plate (120) having nozzle holes (119) is connected to the upper surface of the flow path plate (118). Each laminated piezoelectric actuator (111) is deformed in the direction of thickness by applying voltage thereto for ejecting ink inside each pressurizing chamber (116) via each nozzle hole (119) in a direction perpendicular to the base plate (110).

2 Claims, 21 Drawing Sheets

METHOD OF MANUFACTURING AN INK-JET HEAD

This is a division, of application Ser. No. 08/619,627 filed Apr. 10, 1996.

BACKGROUND OF THE INVENTION

1. Field of the Invention

The present invention relates to an ink-jet head which selectively deposits ink droplets on an image recording medium, and the methods of manufacturing and driving the same.

2. Description of the Related Art

Of non-impact printers which are largely increasing their share in the market nowadays, ink-jet printers are simplest in principle, and also suitable for color printing. Of the ink-jet printers, so-called drop-on-demand (DOD) type ink-jet printers are the most popular, which eject ink droplets only at the time of forming dots.

As representative head systems in the DOD type ink-jet printers, for example, there is a Kaiser type one as disclosed in Japanese Patent Publication No. 53-12138 or a thermal jet type one as disclosed in Japanese Patent Publication No. 61-59914.

However, they have troublesome problems that the Kaiser type ink-jet head described in the Japanese Patent Publication No. 53-12138 is hard to be small-sized, while the thermal-jet type ink-jet head described in the Japanese Patent Publication No. 61-59914 has to apply heat having a high temperature to ink, so that the ink scorches and sticks to the head.

As an inkjet head which eliminates both of such drawbacks, there is the one using a piezoelectric element having a piezoelectric strain coefficient $d_{33}$ (referred to as "$d_{33}$ mode type" hereinafter). g The $d_{33}$ mode type ink-jet head comprises in its schematic structure a strip of piezoelectric material (piezoelectric element) and electrodes respectively formed on both of the confronting surfaces of the piezoelectric element, wherein the piezoelectric element is polarized into the same direction as that of an electric field which is formed across the electrodes to have the piezoelectric distortion constant $d_{33}$. The piezoelectric element is extended and contracted in the direction of $d_{33}$ by the electric field applied between the electrodes to apply pressure to an ink pressurizing chamber.

As the $d_{33}$ mode type ink-jet head, there are already known the separate-liquid-chamber-type head as disclosed in Japanese Patent Publication No. 4-52213 and the extendible-liquid-chamber-type head as disclosed in Japanese Patent Publication No. 4-48622.

Of the $d_{33}$ mode type ink-jet heads, a structure of the separate-liquid-chamber-type is shown in FIG. 19.

That is, a plurality of pressurizing chambers 202 formed by covering an upper plate 201 made of polysulfone, on the surface of which a plurality of grooves for ink flow path are formed, with a thin diaphragm 203 made of polysulfone. A plurality of electrode patterns are formed on the diaphragm 203.

On the other hand, a plurality of electrodes 206 are provided on a piezoelectric element 204 which is divided by slits 207. The piezoelectric element 204 is arranged adjacent to the pressurizing chambers 202 such that the electrodes 206 are connected to their corresponding electrode patterns 208 on the diaphragm 203.

An electrode 205 is formed on the surface of the piezoelectric element 204 on the opposite side to the electrodes 206. A U-shaped rigid material 209 forming a common electrode 210 is laminated on a surface forming the electrode 205. Further, the rigid material 209 is connected to the edge portions of the upper plate 201 where ink flow paths are not formed through the diaphragm 203.

Each of the electrode patterns 208 formed on the diaphragm 203 is electrically connected to each of the electrodes 206 provided at an end of the piezoelectric element 204, while the common electrode 210 is electrically connected to the electrode 205 provided on the other end of the piezoelectric element 204.

When a voltage is externally applied between each of the electrode patterns 208 formed on the diaphragm 203 and the common electrode 210 so as to generate an electric field in the same direction as that of polarization of the piezoelectric element 204, the piezoelectric element 204 divided by the slits 207 extends toward the direction of the electric field.

Hereupon, if the rigid material 209 and the upper plate 201 are firmly connected to each other and the rigid material 209 is made rigid enough to bear the stress of the piezoelectric element 204, the piezoelectric element 204 deflects the diaphragm 203 to pressurize ink for filling the pressurizing chambers 202. As the result, it is possible to eject ink via nozzles 211.

FIG. 20 shows a $d_{33}$ mode type ink-jet head according to the other example of a prior art.

The ink-jet head shown in this drawing comprises a laminated piezoelectric actuator 214 formed by alternately laminating plate-shaped piezoelectric material 212 and internal electrodes 213 made of conductive material, instead of the piezoelectric element 204 in the ink-jet head shown in FIG. 19.

This structure in which the deformation of the plate-shaped piezoelectric material 212 is multiplied by the number of laminations can obtain a deformation in the thickness direction ($d_{33}$ direction) large enough to eject ink droplets for the laminated piezoelectric actuator 214.

At this time, the laminated piezoelectric actuator 214 is also deformed in the direction perpendicular to that of polarization ($d_{31}$ direction). However, the deformation in the $d_{33}$ direction in which the amount of deformation is summed up by the number of laminations can generate higher pressure in the pressurizing chambers 202.

FIG. 21 shows the structure of an extendible-liquid-chamber-type $d_{33}$ mode type ink-jet head.

It is composed of piezoelectric elements 222 each being a piezoelectric material strip such as PZT (Lead-Zirco-Titanate), the piezoelectric elements 222 being arranged in parallel between a conductive supporting plate 221 and an insulating cover plate 223 and fixed thereto.

A plurality of narrow channels are formed between the piezoelectric elements 222. These channels are composed of ink flow channels 225 serving as ink chambers/paths and dummy channels 226 serving as spacers, the ink flow channels 225 and dummy channels 226 being arranged alternatively.

The ink flow channels 225 are connected to a common ink chamber 227 which supplies ink to the ink flow channels 225 at an end thereof. The open ends of the ink flow channels 225 serve as printing nozzles.

The piezoelectric elements 222 is polarized into the direction perpendicular to the supporting plate 221 as indicated with an arrow 230, and electrodes 224 are provided corresponding to the ink flow channels 225 on the upper surface of the piezoelectric elements 222 on the side of the cover plate 223. Each of the electrodes 224 is provided for each pair of piezoelectric elements.

When a voltage is applied between the electrode 224 and the conductive supporting plate 221, the piezoelectric elements 222 arranged on both sides of an ink flow channel 225 extend toward the direction of thickness and contract toward the direction of width. As the result of deformation, the capacity of the ink flow channel 225 is increased.

When applying voltage to the electrode 224 is stopped, the two piezoelectric elements 222 return to their original shape, abruptly reducing the capacity of ink flow path. As the result, an ink droplet 228 is ejected from a printing nozzle formed at the end portion of the path.

A purpose of the present invention is to solve the following problems inherent in the ink-jet head having a structure in which strips of piezoelectric material are polarized into the direction of electric field to have the piezoelectric strain coefficient $d_{33}$ as described above, i.e., the $d_{33}$ mode type ink-jet head.

That is, a first problem is that the $d_{33}$ mode type ink-jet head is structurally difficult to be miniaturized by increasing the density of arranging the printing nozzles and the degree of integrating the same.

For example, in case of the separate-liquid-chamber-type ink-jet head shown in FIG. 19, the piezoelectric elements 204 are arranged in a line forward the slits 207 among them for separating adjacent piezoelectric elements 204, so that the manufacturing limit of the slits 207 determines the pitch of the printing nozzles 211, and consequently it is impossible to densify the nozzle pitch. Incidentally, the limit of manufacturing slits using the wire-saw electron discharge method is up to about 150 to 200 slits per inch.

Moreover, an extendible-liquid-chamber-type ink-jet head shown in FIG. 21 also has a limited pitch of arranging the piezoelectric elements 222 same as the separate-liquid-chamber-type head and requires also the dummy channels 226 which do not eject ink, in every other row, so that it is all the more difficult to arrange nozzles with high density.

A second problem is that it is difficult to electrically connect power source to the piezoelectric elements to drive the same, and that the number of manufacturing steps is increased and the reliability of electrical connection is low.

For example, in case of the separate-liquid-chamber-type as shown in FIG. 19, the electrodes 205 and 206 have to be manufactured separately on the surface side of the piezoelectric element 204 confronting the diaphragm 203 and on the surface side thereof confronting the rigid material 209.

Furthermore, driving the piezoelectric elements 204 by these electrodes 205 and 206 alone requires tight junction leaving no space therebetween, which was very difficult in the machining technology.

Furthermore, there was a drawback that, in case of forming the other electrode on the piezoelectric element 204, the manufacturing cost was increased.

Furthermore, when the external signal lines are connected to the electrodes, troublesome work is required to connect them individually since the electrode patterns 208 on the diaphragm 203 and the common electrode 210 are differently positioned.

Furthermore, the electrode patterns 208 have to be previously made on the diaphragm 203 in advance, and also the material of the diaphragm 203 is limited to nonconductive one.

Also in case of the extendible-liquid-chamber-type one as shown in FIG. 21, the external signal lines have to be electrically and separatedly connected to the electrodes 224 and the conductive supporting plate 221 which serves as the common electrode.

A third problem is that nozzle holes for ejecting ink droplets are liable to be blocked with or leak ink.

That is, since the nozzles for ejecting ink are formed at the end portions of piezoelectric elements arranged with high density in both of the separate-liquid-chamber-type and the extendible-liquid-chamber-type, it is impossible to secure a space for installing a cap mechanism for preventing the evaporation of moisture from menisci, i.e., the liquid levels of ink in the nozzle holes, or a suction mechanism used when the nozzle holes are blocked with ink.

Moreover, even if the ink-jet head comprises a nozzle plate having a relatively large surface area and the nozzle holes formed at the end portions of piezoelectric elements, it is difficult to seal the nozzle plate so as to prevent ink from leaking, since very thin members such as the base plate, piezoelectric elements, diaphragm etc. have to be connected to the nozzle plate.

Also in case of employing a metal nozzle plate, since the upper plate 201 made of polysulfone and the diaphragm 203 have different coefficients of linear expansion, the change in temperature causes the deformation of members, resulting in the breakage of structure.

A fourth problem is that the energy loss or interference between pressurizing chambers is liable to occur, which causes the insufficiency or fluctuation of the ink ejecting force to reduce the performance of the ink-jet head.

When the piezoelectric element is displaced forward the direction of thickness ($d_{33}$ direction), the displacement occurs toward the direction ($d_{31}$ direction) perpendicular thereto.

Since the piezoelectric element and the diaphragm or the base plate are connected to each other through an electrode, the $d_{31}$ direction displacement of the piezoelectric element causes unimorph deformation between the diaphragm and itself.

Accordingly, in case of the separate-liquid-chamber-type ink-jet head, the unimorph deformation causes the deflection of the diaphragm 203. As the result, there occurs a loss in the thickness-direction displacement of the piezoelectric element 204, so that extra energy is needed for ejecting ink.

In case of the extendible-liquid-chamber-type ink-jet head, the unimorph deformation deflects the supporting plate 221 and the insulating cover plate 223 to cause interference between ink flow channels.

A fifth problem is that it requires the high accuracy assembling and is difficult to manufacture.

In case of the separate-liquid-chamber-type ink-jet head as shown in FIG. 19, the piezoelectric element 204 and the rigid material 209 have to be connected to the diaphragm 203 with high accuracy of positioning which allows no deviation in order to transmit the minute deformation of the piezoelectric element 204 to the diaphragm 203.

In case of the conventional structure in which electrodes 206 are formed at an end of the piezoelectric element 204 and brought into contact with the diaphragm 203, however, it is impossible to flatten the portions of the rigid material 209 and the piezoelectric element 204 which are connected to the diaphragm 203 by machining such as surface grinding. Accordingly, it was difficult to connect with high accuracy.

An object of the present invention is to solve such problems in the $d_{33}$ mode type ink-jet head as described above and provides an ink-jet head which causes little energy loss, and can be efficiently driven and manufactured at low cost due to its simple and small-sized structure, and has high reliability, and density, as well as the methods of manufacturing and driving such an ink-jet head.

SUMMARY OF THE INVENTION

To achieve the above object, an ink-jet head according to the present invention employs the following structure.

That is, an ink-jet head according to a first aspect of the present invention comprises a base plate, a laminated piezoelectric actuator unit composed of pairs of laminated piezoelectric actuators each having a piezoelectric strain coefficient $d_{33}$, the laminated piezoelectric actuators having collective electrodes formed on both end surfaces thereof and being arranged in plural rows confronting each other on the base plate, a common electrode being formed by electrically connecting together the collective electrodes formed on confronting end surfaces, which are formed at the central portion of the base plate, of the laminated piezoelectric actuators, and driving electrodes composed of the collective electrodes formed on -the other end surfaces of the laminated piezoelectric actuators, wherein ink inside pressurizing chambers is ejected by driving each of the laminated piezoelectric actuator.

Owing to the structure of the present invention, it is possible to provide a small-sized ink-jet head having high density of mounting, as well as high resolution.

Moreover, in the ink-jet head according to the first aspect of the present invention, the laminated piezoelectric actuator unit can be easily formed by a laminated piezoelectric element block and forming a first slit at the central portion thereof to divide the same, the laminated piezoelectric element block being provided on the upper surface of the base plate, and forming a plurality of second slits shallower than the first slit in a direction substantially perpendicular thereto.

Hereupon, since the laminated piezoelectric actuator is small-sized and has high rigidity, the limitation of slit machining is improved. As the result, it is possible to reduce the nozzle pitch by reducing the slit pitch.

Moreover, in the ink-jet head according to the first aspect of the present invention, the uppermost and lowermost layers of each laminated piezoelectric actuator can be dummy layers which are not driven.

Since the upper surface of the laminated piezoelectric actuator can be positioned with high accuracy by means of grinding, and the like, owing to this arrangement, the quality of assembling becomes stable and it is possible to provide an ink-jet head which can be reduced in the number of manufacturing steps and in cost as well. Furthermore, since the unnecessary deformation of the laminated piezoelectric actuator in a direction perpendicular to that of thickness of this actuator is not transmitted to other members, it is possible to prevent energy loss or interference between the pressurizing chambers.

Furthermore, in the ink-jet head according to the first aspect of the present invention, it is possible to form a plurality of driving electrodes each electrically connected to the driving electrode of its corresponding laminated piezoelectric actuator on the base plate.

Forming the driving electrodes on the base plate as described above facilitates electrical connection to the outside.

An ink-jet head according to a second aspect of the present invention comprises a base plate, a laminated piezoelectric actuator unit composed of pairs of laminated piezoelectric actuators each having a piezoelectric strain coefficient $d_{33}$, the laminated piezoelectric actuators having collective electrodes formed on both end surfaces thereof and being arranged in plural rows confronting each other on the base plate, a common electrode being formed by electrically connecting together collective electrodes formed on confronting end surfaces, which are formed at the central portion of the base plate, of the laminated piezoelectric actuators, the driving electrodes being composed of the collective electrodes formed on the other end surfaces of the laminated piezoelectric actuators, a diaphragm connected to the upper end surface of the laminated piezoelectric actuator unit, a flow path plate which has a plurality of pressurizing chambers and an ink supply path, each pressurizing chamber corresponding to each laminated piezoelectric actuator and being connected to the diaphragm, and a nozzle plate which has a plurality of nozzle holes each corresponding to each of the pressurizing chambers and which is connected to the upper surface of the flow path plate.

Such a structure facilitates miniaturizing the ink-jet head and increases the surface area of the nozzle plate as well and also facilitates attaching the cap mechanism which prevents the menisci in the nozzle holes from drying, or the maintenance mechanism which recovers the ink-jet head from being blocked with ink.

Moreover, in the ink-jet head according to the second aspect of the present invention described above, it is possible to make the laminated piezoelectric actuators located in the first and last rows of the laminated piezoelectric actuator unit undriven and inactive and support the both end portions of the flow path plate described above by the upper end surfaces of these laminated piezoelectric actuators.

This structure can firmly combine the laminated piezoelectric actuator unit with -the pressurizing chambers. As the result, it becomes possible to positively transmit the displacement of each laminated piezoelectric actuator to its corresponding pressurizing chamber and consequently provide an ink-jet head having a strong ink-ejecting force.

An ink-jet head according to a third aspect of the present invention comprises a base plate, a laminated piezoelectric actuator unit composed of pairs of laminated piezoelectric actuators each having a piezoelectric strain coefficient $d_{33}$, the laminated piezoelectric actuators having collective electrodes formed on both end surfaces thereof and being arranged in double rows confronting each other on the base plate, the supports provided on the upper surface of the base plate at both sides of the laminated piezoelectric actuator unit, a diaphragm connected to the upper surfaces of the laminated piezoelectric actuator unit and the supports, a flow path plate which has a plurality of pressurizing chambers and an ink supply path, each pressurizing chamber corresponding to each laminated piezoelectric actuator and which is connected to the upper surface of the diaphragm, and a nozzle plate which has a plurality of nozzle holes each corresponding to each pressurizing chamber and which is connected to the upper surface of the flow path plate.

The structure of the present invention can firmly fix the flow path plate by the supports to positively transmit the displacement of each laminated piezoelectric actuator to its corresponding pressurizing chamber, so as to provide an ink-jet head having a strong ink-ejecting force and minimize the interference between the adjacent laminated piezoelectric actuators.

The ink-jet head according to the third aspect of the present invention described above can electrically connect together the collective electrodes formed on the confronting end surfaces of laminated piezoelectric actuators at the central portion of the base plate to form a common electrode, while making the collective electrodes formed on the other end surfaces of the laminated piezoelectric actuators driving electrodes.

This structure can reduce the number of contacts for external electrical connection and mount the laminated piezoelectric actuators on the base plate with high density.

Moreover, in case of the inkjet head according to the third aspect of the present invention described above, the both side end portions of the diaphragm may be clamped by the supports and the flow path plate.

This structure can firmly fix the diaphragm by the supports and the flow path plate, so that the supporting condition becomes stable, and that it is possible to equalize the ink-ejecting performance between pressurizing chambers.

Furthermore, the ink-jet head according to the third aspect of the present invention may comprise a second support for supporting the diaphragm at the central portion of the upper surface of the base plate.

This structure makes the supporting condition of the diaphragm more stable.

The ink-jet head according to the third aspect of the present invention may elastically support the outer side end surface of each laminated piezoelectric actuator by means of a support.

This structure does not restrict the deformation of the laminated piezoelectric actuators by the support both in the direction of thickness and the direction perpendicular thereto, so that the deformation loss of the laminated piezoelectric actuator in the direction of thickness does not take place. As the result, it is possible to maintain a high performance of inkejecting.

An ink-jet head according to a fourth aspect of the present invention comprises a laminated piezoelectric actuator unit composed of pairs of laminated piezoelectric actuators each having a piezoelectric strain coefficient $d_{33}$, the laminated piezoelectric actuators having collective electrodes formed on both end surfaces thereof and being arranged in plural rows confronting each other on the base plate, a diaphragm bonded to the upper end surface of the laminated piezoelectric actuator unit, a flow path plate which has a plurality of pressurizing chambers and an ink supply path, each pressurizing chamber corresponding to each laminated piezoelectric actuator, and a nozzle plate which has a plurality of nozzle holes each corresponding to each of the pressurizing chambers, wherein the laminated piezoelectric actuators in every other row are driven actuators and other laminated piezoelectric actuators are undriven actuators, the diaphragm being clamped between the inactive actuators and the flow path plate, and the nozzle plate being bonded to the upper surface of the flow path plate.

Such a structure can support the diaphragm under a more stable condition and maintain the stable ink-ejecting performance.

Hereupon, in case of the ink-jet head according to the second, third and fourth aspects of the present invention, it is also possible to dispose each laminated piezoelectric actuator and each pressurizing chamber aslant to an axis perpendicular to those crossing nozzle holes each formed corresponding to each pressurizing chamber.

This structure allows the nozzles to be arranged at one half of pitch of the laminated piezoelectric actuators to realize the high-density printing performance.

Moreover, in case of the ink-jet head according to the second, third and fourth aspects of the present invention, it is preferable that at least the laminated piezoelectric actuators, the diaphragm, the flow path plate, and the nozzle plate have the substantially same coefficient of linear expansion.

With such structure, at least the laminated piezoelectric actuators, the diaphragm, the flow path plate, and the nozzle plate are extended and contracted uniformly with the change in temperature, so that inconvenient stress does not occur between the members.

Next, a method of driving the ink-jet head according to the present invention comprises a first step of applying voltage to the laminated piezoelectric actuators in the polarized direction thereof to extend the same in the direction of thickness, a second step of gradually reducing the applied voltage to fill the pressurizing chambers with ink, and a third step of abruptly increasing the applied voltage again so as to extend the laminated piezoelectric actuators in the direction of thickness and eject the ink inside the pressurizing chamber.

According to the driving method, since an electric field is constantly applied to the laminated piezoelectric actuators in the same direction as that of polarization, an inversed polarization which weakens the polarization of the laminated piezoelectric actuators does not occur, and also the oscillation of liquid surfaces (menisci) in the nozzle holes which is caused by the oscillation of ink generated in pressurizing chambers can be eased by the second step of gradually supplying ink, so that there is no variation in the speed or diameter of ejected ink droplets even if the laminated piezoelectric actuators are driven with different frequencies.

A method of manufacturing an ink-jet head according to the first aspect of the present invention comprises a first step of forming a first slit at the central portion of a laminated piezoelectric body, a second step of forming electrodes at the both end portions of the laminated piezoelectric body and the first slit, a third step of forming a plurality of second slits shallower than the first slit at a given pitch in a direction substantially perpendicular thereto to form a plurality of laminated piezoelectric actuators on the base plate, and a fourth step of flattening the upper surface of the laminated piezoelectric actuators.

Such manufacturing method enables a small-sized laminated piezoelectric actuator unit to be easily manufactured at low cost.

The method of manufacturing an ink-jet head according to the first aspect of the present invention may also comprise a first step of forming a first slit at the central portion of a laminated piezoelectric body, a second step of forming electrodes on both end portions of the laminated piezoelectric body and on the first slit, a third step of flattening the upper surfaces of the laminated piezoelectric actuators, and a fourth step of forming a plurality of second slits shallower than the first slit at a given pitch in the direction substantially perpendicular thereto to form a plurality of laminated piezoelectric actuators on a base plate.

Such a manufacturing method also enables a small-sized laminated piezoelectric actuator unit to be easily manufactured at low cost.

An ink-jet head according to a fourth aspect of the present invention comprises a base plate, a plurality of partitions formed by laminating plate-shaped piezoelectric material layers polarized into the direction of thickness through conductive material layers interposed between them, a cover, and a sealing member, wherein the plural partitions are arranged with given gaps interposed between them on the base plate, the gaps are sealed with the cover at the upper portion thereof and by the sealing member at the side portions thereof to form pressurizing chambers, and a nozzle hole is formed at a portion of each of the pressuring chambers.

Such a structure can provide an ink-jet head which is manufactured with a few number of members and has a good performance of ink-ejecting.

Moreover, in the ink-jet head according to the fourth aspect of the invention, the partitions are constituted as laminated piezoelectric actuators, with the piezoelectric strain coefficient $d_{33}$, which are deformed in the direction of thickness when voltage is applied thereto.

An ink-jet head according to a fifth aspect of the present invention comprises a base plate, a plurality of partitions formed by alternately laminating plate-shaped piezoelectric material layers polarized in the direction of thickness with conductive material layers interposed between them, a cover and a sealing member, wherein the plural partitions are arranged in matrix with predetermined gaps between them on the base plate, the gaps being covered with the cover at the upper portion thereof and by the sealing member at the side portions thereof to form the pressurizing chambers, a nozzle hole for each pressurizing chamber is formed at a portion of each pressurizing chamber in either the base plate or the cover, and an ink supply port being formed at a portion of each pressurizing chamber on either the base plate, the sealing member or the cover, wherein each partition is deformed in the direction of thickness by applying voltage to the conductive material layers of the partition to change the capacity of each pressurizing chamber filled with ink so as to eject ink droplets via each nozzle hole.

Such a structure can also provide an ink-jet head which has a small number of members, as well as the good ink-ejecting performance.

In case of the ink-jet head according to the fourth and fifth aspects of the present invention, the gaps formed between the partitions may also be alternately pressurizing chambers for supplying ink in a direction of lamination and dummy spaces which do not supply ink.

Owing to the above structure, it is possible to concurrently eject ink droplet via the adjacent nozzles.

The ink-jet head according to the fourth and fifth aspects of the present invention can also be constituted such that pressurizing chambers are covered with individual covers. As the result, it is possible to reduce interference between the pressurizing chambers.

The ink-jet head according to the fourth and fifth aspects of the present invention can be constituted such that the gaps forming the dummy spaces are smaller in width than those forming the pressurizing chambers, thereby increasing the pitch of nozzle holes.

The ink-jet head according to the fourth and fifth aspects of the present invention can be constituted such that insulating coating films are provided on the partitions on the surfaces thereof confronting the pressurizing chambers, thereby enabling the water-soluble ink, therefore, insulation can be secured for electrodes made of conductive material exposed on the surface of the partitions.

DETAILED DESCRIPTION OF THE PREFERRED EMBODIMENTS

An ink-jet head according to the embodiments of the present invention is described hereinafter with reference to drawings.

Figure 1:
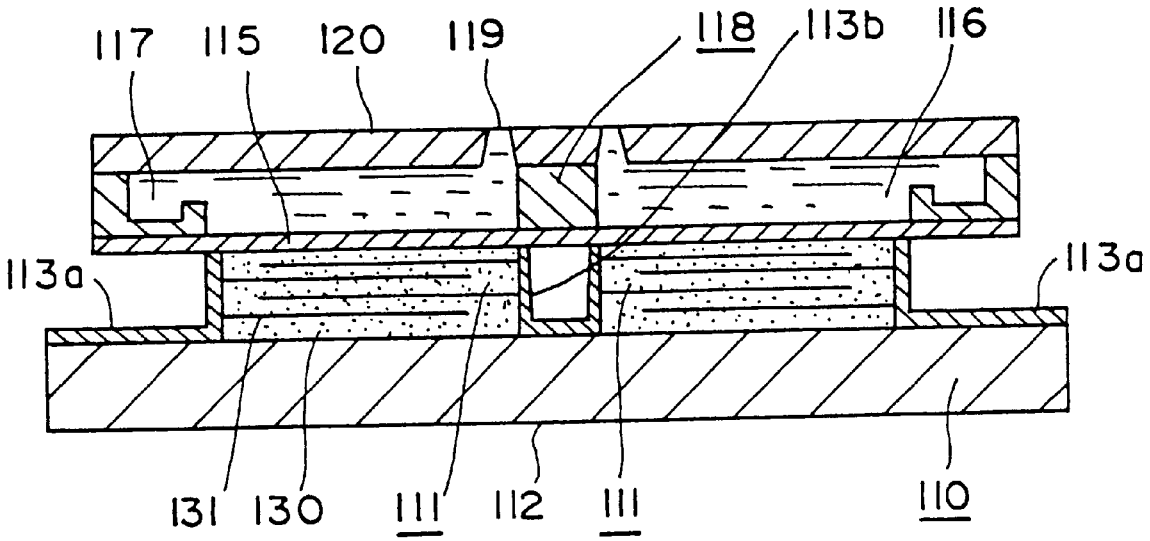
FIG. 1 is a front elevational cross sectional view of an ink-jet head showing a structure thereof according to a first embodiment of the present invention.
Figure 2:
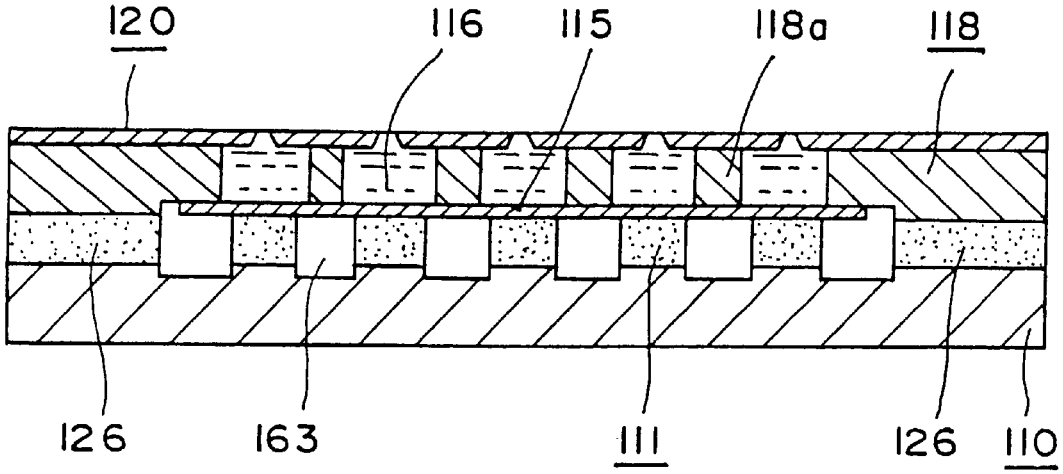
FIG. 2 is a side elevational cross sectional view of the ink-jet head showing a structure thereof according to the first embodiment of the present invention.

FIGS. 1 and 2 show an ink-jet head according to a first embodiment of the present invention, wherein FIG. 1 is a front elevational cross-sectional view, and FIG. 2 is a side cross-sectional view.

As shown in FIG. 1, the ink-jet head according to this embodiment comprises a pair of laminated piezoelectric actuators 111 and 111. These pairs of laminated piezoelectric actuators 111 and 111 are formed by alternately laminating the plate-shaped piezoelectric material layers 130 of piezoelectric ceramic made of a compound of lead zirconia and lead titanium and the conductive material 131 made of silver-palladium, so as to expose the conductive material layers 131 from the end surfaces thereof.

The pairs of laminated piezoelectric actuators 111 and 111 are arranged in series on a base plate 110 made of ceramic etc. so as to form a matrix laminated piezoelectric actuator unit 112, a plurality of rows of which are perpendicular to the surface of the paper (see FIG. 2).

An electrode film is formed on the outer end surface of each laminated piezoelectric actuator 111 on which the conductive material layers 131 are exposed, the electrode film serving as a driving collective electrode 113*a* to which voltage can be applied from outside.

On the other hand, since the central-portion-side end surfaces of the pair of laminated piezoelectric actuators 111 confront each other, the electrode film continuously covering these end surfaces is formed to be a common collective electrode 113*b* serving as a common electrode for the conductive material layers 131 exposed on the end surfaces. Thus, the common collective electrode 113*b* serving as a common electrode for the conductive material layers 131 serves as a common electrode for the pair of laminated piezoelectric actuators 111 (see FIG. 1).

With this structure, each laminated piezoelectric actuator 111 can be driven by applying voltage between each driving collective electrode 113*a* and the common collective electrode 113*b* that is a common electrode.

As shown in FIG. 1, the electrode films of the driving collective electrodes 113*a* and the common collective electrode 113*b* can be extended onto the base plate 110 so as to facilitate electrical connection to the outside.

Using the confronting central end surfaces of the pair of laminated piezoelectric actuators 111 as the common electrode as described above can reduce the distance therebetween, so that the laminated piezoelectric actuators 111 can be mounted with high density. Moreover, It has also the advantage that the number of contacts for electrical connection to the outside can be reduced.

A metal diaphragm 115 is bonded to the upper surface of the laminated piezoelectric actuators 111. A metal flow path plate 118 comprising a plurality of pressurizing chambers 116 and a common ink flow path 117 communicating with an unillustrated external ink tank formed thereon is bonded to the upper surface of the metal diaphragm 115.

Hereupon, each pressurizing chamber 116 to be filled with ink is formed at the position adjacent to its corresponding laminated piezoelectric actuator 111 through the diaphragm 115 therebetween.

The flow path plate 118 and the metal diaphragm 115 may be made as an integral member, not as separate members.

A metal nozzle plate 120 having a plurality of nozzle holes is bonded to the upper surface of the flow path plate 118. Each nozzle hole 119 is arranged at the position where it communicates with its corresponding pressurizing chamber 116.

As shown in FIG. 2, of the plural laminated piezoelectric actuators 111 arranged on the base plate 110, the laminated piezoelectric actuators 126 and 126 located at the foremost and rearmost positions are inactive ones which are not driven. These undriven laminated piezoelectric actuators 126 and 126 secure a sufficient dimension of width compared with that of driven laminated piezoelectric actuators 111 and have high rigidity.

The base plate 110 and the flow path plate 118 which comprises the pressurizing chambers 116 formed thereon are firmly connected to each other through the undriven laminated piezoelectric actuators 126 and 126.

Hereupon, the diaphragm 115 is not disposed between the undriven inactive laminated piezoelectric actuators 126 and 126 and the flow path plate 118, so that the diaphragm 115 is not bonded to these laminated piezoelectric actuators 126 and 126.

When the laminated piezoelectric actuator 111 is driven to push the diaphragm 115 toward its corresponding pressurizing chamber 116 due to the deformation of the laminated piezoelectric actuator 111, the deformed diaphragm 115 is supported by the partitions 118*a* of the flow path plate 118. If the partitions 118*a* are made of hard material and are bonded to the metal diaphragm 115 through a joint surface having sufficient width, the supporting condition of the diaphragma 115 is regarded as being under the firm fixation at both ends of a beam.

In order to mount them with high density, however, each of the partitions 118*a* of the flow path plate 118 can secure a width of about 10 to 40 $\mu$m, so that it cannot have enough rigidity. Accordingly, it is inevitable that the diaphragm 115 is somewhat elastically supported. Particularly when the flow-path plate 118 is formed of a material with low rigidity such as plastics etc., the diaphragm 115 is more elastically supported.

Accordingly, if the diaphragm 115 is extended as far as the undriven laminated piezoelectric actuators 126 and 126 which secure enough width and have high rigidity so as to be clamped by the laminated piezoelectric actuators 126 and 126 and the flow path plate 118, the supporting condition of the metal diaphragm 115 becomes firm at both ends thereof, but remains elastic at the central portion thereof, so that the performance of transmitting oscillation becomes uneven throughout the diaphragm 115.

As the result, the pressure applied to the pressurizing chambers 116 varies with the position, so that there occurs a phenomenon that the characteristic of ejecting ink droplets becomes uneven throughout the entire ink-jet head.

Actually in an inkjet head having such a structure, even if the flow path plate 118 is formed of a metal material having high rigidity, there was a difference of about 10 to 14 percent in the speed of ejecting ink droplets between a nozzle hole 119 at the central portion thereof and a nozzle hole 119 adjacent to the undriven laminated piezoelectric actuators 126 and 126. Moreover, when the flow path plate 118 was formed of plastics such as PSF etc., with low rigidity, there was a difference of about 30% in the speed of ejecting ink droplets.

When the speed of ejecting ink droplets varies with the position as described above, in case of a so-called serial printer which forms characters or images by scanning a paper with a print head, there occurs a variation in time until ink droplets reach the paper that is a printing medium. As the result, the position of a pixel formed by an ink droplet sticking to the paper. is deviated to cause the deterioration of printing quality.

On the other hand, when the ink-jet head has a structure in which the undriven laminated piezoelectric actuators 126 and 126 and the diaphragm 115 are not bonded to each other, the supporting condition between the metal diaphragm 115 and the flow path plate 118 becomes same anywhere, so that the speed of ejecting ink droplets can be uniformed all over the ink-jet head when a jet of ink is ejected from a pressurizing chamber 116 by driving its corresponding laminated piezoelectric actuator 111.

Furthermore, if pressurizing chambers 116 adjacent to the undriven laminated piezoelectric actuator 126 are made dummy ones and ink is not ejected therefrom, the unevenness of speed of ejecting ink droplets as described above can be almost solved. Providing such dummy pressurizing chambers 116, however, results in the waste of space, and is not favorable for miniaturization.

A method of manufacturing the matrix laminated piezoelectric actuator unit 112 in the ink-jet head set forth above will be described hereinafter.

FIG. 3A, FIG. 3B, FIG. 3C, and FIG. 4 are the perspective views showing the method of manufacturing the matrix laminated piezoelectric actuator unit 112 described above, wherein the manufacturing steps are shown in order.

Figure 3A:
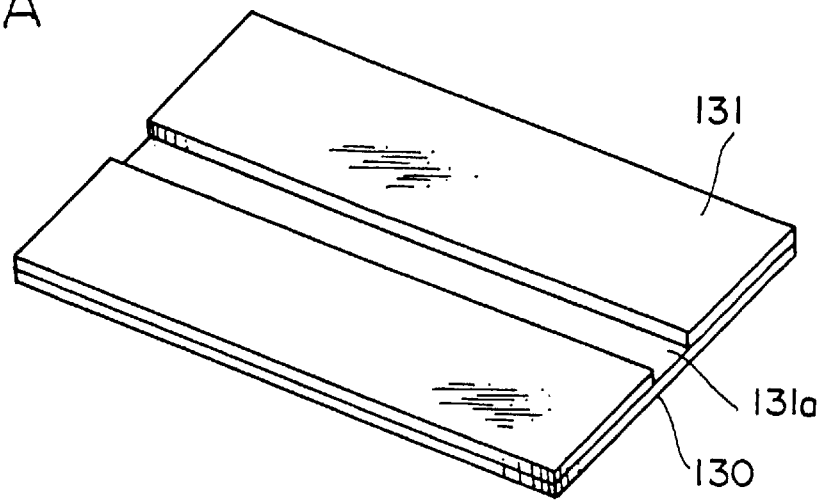
FIG. 3A is a perspective view of a laminated piezoelectric element block constituting the ink-jet head showing a method of manufacturing the same according to the first embodiment of the present invention.

As shown in FIG. 3A, the first conductive material layer 131 is formed by the printing method on a first green sheet which is made of piezoelectric ceramic and is to be the plate-shaped piezoelectric material layer 130. At this time, the central portion of the plate-shaped piezoelectric material layer 130 is not covered with the first conductive material layer 131 to be a first exposed portion 130*a*.

Figure 3B:
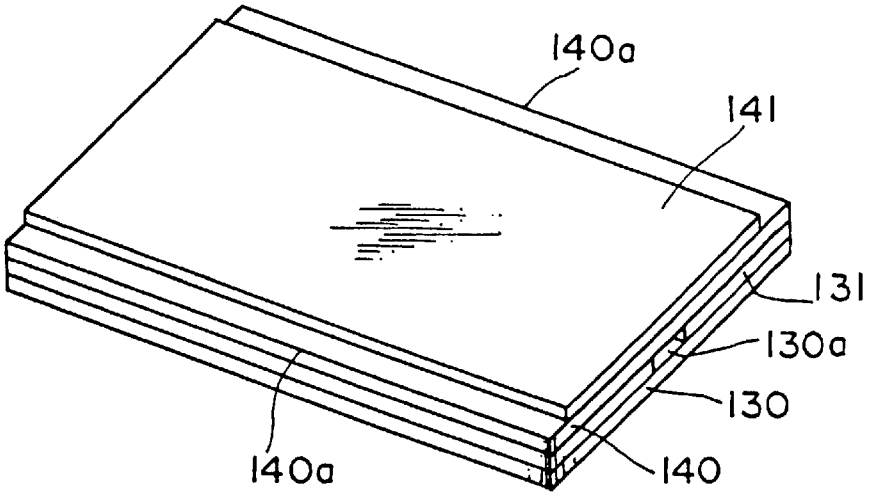
FIG. 3B is a perspective view of a laminated piezoelectric element block constituting the ink-jet head showing the method of manufacturing the same following the preceding drawing according to the first embodiment of the present invention.

Then, as shown in FIG. 3B, a second green sheet to become into a plate-shaped piezoelectric material layer 140 is laminated on the first conductive material layer 131, and then a second conductive material layer 141 is formed on the upper surface of the plate-shaped piezoelectric material layer 140 by the printing method. At this time, the both end surfaces of the plate-shaped piezoelectric material layer 140 remain uncovered by the second conductive material layer 141 to be a second exposed portions 140*a*.

Figure 3C:
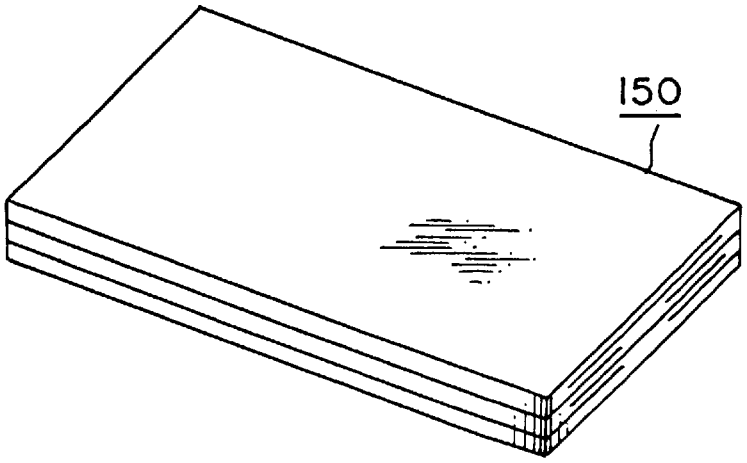
FIG. 3C is a perspective view of the laminated piezoelectric element block constituting the ink-jet head showing a method of manufacturing the same following the preceding drawing according to the first embodiment of the present invention.

In this way, the green sheets to be made into the plate-shaped piezoelectric material layers and the conductive material layers are laminated one after another, and then subjected to the pressurized sintering process to form a piezoelectric element block 150 as shown in FIG. 3C.

Figure 4:
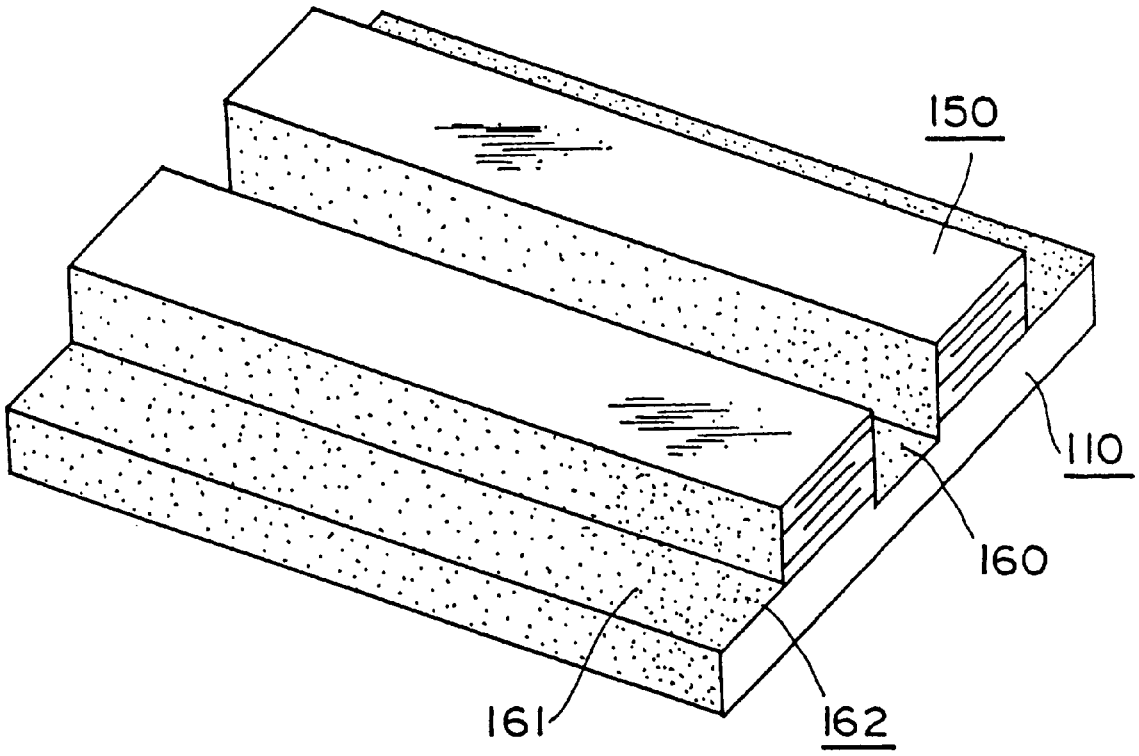
FIG. 4 is a perspective view of a laminated piezoelectric actuator constituting the ink-jet head showing a method of manufacturing the same according to the first embodiment of the present invention.

Next, as shown in FIG. 4, the piezoelectric element block 150 is bonded to the base plate 110, and successively a first slit 160 reaching the base plate 110 is formed by using a cutting tool such as a diamond cutter, etc.

Thereafter a thin gold (Au) film is formed all over the piezoelectric element block 150 and the base plate 110 through a thin film forming means such as vacuum evaporation and the like, thereby forming an electrode film 161 on the upper surface of the base plate 110, the end surfaces of the piezoelectric element block 150 and the inner surface of the first slit 160.

After that, the electrode film 161 is removed from the upper surface of the piezoelectric element block 150 and other unnecessary surfaces by surface grinding etc. to form a laminated piezoelectric actuator block 162 as shown in FIG. 4.

The second slits 163 shown in FIG. 2 (not shown in FIG. 4) are formed in the thus formed laminated piezoelectric actuator block 162 in a direction substantially perpendicular to the first slit 160 with a diamond cutter, etc. Each of the second slits 163 reach the base plate 110 but is made shallower than the first slit 160. Forming the second slits 163 successively at a given pitch completes the laminated piezoelectric actuator 111.

According to the manufacturing step set forth above, the electrode film 161 shown in FIG. 4 is divided into a plurality of patterns to be capable of individually driving each laminated piezoelectric actuator 111. The laminated piezoelectric actuators 111 are subjected to the polarizing process in the direction of thickness by applying sufficient voltage thereto through the electrode film 161.

The inventor of the present invention used 22 plate-shaped piezoelectric material layers 130 each having the thickness of 20 $\mu$m and 21 first conductive material layers 131 to constitute a laminated piezoelectric actuator 111 having the thickness of about 0.5 mm by laminating them one after another.

Since the laminated piezoelectric actuator 111 was as small as 0.5 mm in a dimension of thickness and was firmly bonded to the base plate 110 at the bottom portion thereof with high rigidity at junction, there was no likelihood that the laminated piezoelectric actuators 111 arranged on the base plate 110 fell down due to machining etc. As the result, the pitch of arranging the laminated piezoelectric actuators 111 could be made more than 150 per inch.

Furthermore, a distance between the pair of confronting laminated piezoelectric actuators 111 can be less than 0.5 mm since a common electrode is formed by electrically connecting together the confronting sides of the paired laminated piezoelectric actuators 111 at the central portion of the base plate, while individual driving electrodes of the laminated piezoelectric actuators 111 are formed on the outer sides thereof. By using such a simple method of machining it is possible to constitute a laminated piezoelectric actuator with high density of mounting on a plane.

Furthermore, according to the structure of the matrix laminated piezoelectric actuator unit 112 and the method of manufacturing the same as set forth above, no conductive material layer 131 is formed on the upper surface of the uppermost plate-shaped piezoelectric material layer 130 of the laminated piezoelectric actuator 111 and on the lower surface of the lowermost plate-shaped piezoelectric material layer 130 thereof. Therefore, the uppermost and lowermost plate-shaped piezoelectric material layers 130 are dummy layers to which no voltage is applied.

When voltage is applied to a laminated piezoelectric actuator 111 polarized in the direction of thickness, it is extended in a direction of thickness ($d_{33}$ direction). At the same time, individual plate-shaped piezoelectric material layers 130 contract in the longitudinal direction ($d_{31}$ direction) perpendicular thereto. However, when the uppermost and lowermost plate-shaped piezoelectric material layers 130 are made dummy layers as described above, they do not generate such deformation, so that they do not exert compulsory deforming force on the metal diaphragm 115 and the base plate 110, which are connected to the upper and lower surfaces of the uppermost and lowermost plate-shaped piezoelectric material layers 130, respectively.

That is, when the uppermost and lowermost plate-shaped piezoelectric material layers 130 of the laminated piezoelectric actuator 111 are made as dummy layers, the deformation of the laminated piezoelectric actuator 111 in the longitudinal direction thereof can be absorbed into the laminated piezoelectric actuator 111 that is a relatively soft member, so as to prevent the metal diaphragm 115 and the base plate 110, which are connected thereto from being deformed.

As the result, it is possible to prevent energy loss due to the longitudinal deformation of the metal diaphragm 115 and cross talk between the laminated piezoelectric actuators 111 due to the deformation of the base plate 110.

Furthermore, according to the structure of the matrix laminated piezoelectric actuator unit 112 and the method of manufacturing the same as described above, it is possible to manufacture the inkjet head with ease and with high accuracy by successively laminating the laminated piezoelectric actuator unit 112, a metal diaphragm 115, the flow path plate 118 and the nozzle plate 120 and bonding them together.

And it is possible to easily form a nozzle plate 120 having a large surface area, to sufficiently secure space for installing the cap mechanism for preventing the vaporization of moisture from menisci as ink levels in the nozzle holes 119, and to sufficiently secure a space for installing the suction mechanism which is used when the nozzle holes 119 are blocked with ink droplets. Moreover, it is possible to easily form seal for preventing ink leakage since the nozzle plate 120 and the flow path plate 118 can be bonded together through a relatively large surface.

The ejecting operation of the ink-jet head set forth above is described hereinafter.

At a first step of operation, voltage is applied between the driving collective electrode 113*a* and the common collective electrode 113*b* to generate an electric field in the plate-shaped piezoelectric material layers 130 in the polarized direction thereof, thereby gradually extending the laminated piezoelectric actuator 111 in the direction of thickness ($d_{33}$ direction). This action of the laminated piezoelectric actuator 111 pushes a portion of the diaphragm 115 into a pressurizing chamber 116 so as to reduce its capacity in advance. At this time, the laminated piezoelectric actuator 111 is driven slowly enough to prevent the ink inside the pressurizing chamber 116 from being ejected via the nozzle hole 119.

The inventor of the present invention executed the embodiments under the condition that the piezoelectric strain coefficient $d_{33}$ of the laminated piezoelectric actuator 111 was $450\times10^{12}$ m/V, and the number of plate-shaped piezoelectric material layers 130 was 20 excluding dummy layers. When a voltage of 30 V was applied between the driving collective electrode 113*a* and the common collective electrode 113*b*, the plate-shaped piezoelectric material layer 130 was extended by about 0.014 $\mu$m per layer in the direction of thickness, so that the laminated piezoelectric actuator 111 was extended by 0.27 $\mu$m as a total in deformation of 20 plate-shaped piezoelectric material layers 130.

This amount of deformation reduces the capacity of a pressurizing chamber 116 by the amount substantially equal to that of an ink droplet ejected at a time.

Then, the operation proceeds to a second step, wherein the electric field generated in the preceding step is gradually weakened to reduce the displacement of the laminated piezoelectric actuator 111. As the result, the capacity of the pressurizing chamber 116 is increased, compared with that at the first step of operation, so that ink is supplied to the pressurizing chamber 116 through the common ink flow path 117 shown in FIG. 1.

At a third step of operation, an electric field is abruptly generated in the polarized direction of the plate-shaped piezoelectric material layers 130 to extend the laminated piezoelectric actuator 111 in the direction of thickness ($d_{33}$ direction). At this time, the pressure in the pressurizing chamber 116 is abruptly increased to eject the ink filling the pressurizing chamber 116 via the nozzle hole 119.

Finally, at a fourth step of operation, an voltage having the same level as that of the first step is applied to the laminated piezoelectric actuator 111. The fourth step of operation may be omitted by making the applied voltage at the first step equal to that at the third step.

According to such a driving method, since an electric field is always applied to the laminated piezoelectric actuator 111 in the same direction as that of polarization, it is possible to prevent the generation of inverted polarization which weakens the polarization of the laminated piezoelectric actuator 111. Moreover, it is possible to equalize the ejecting speed or the diameter of ink droplets since the oscillation of liquid surfaces (menisci) in the nozzle holes 119 following that of ink liquid generated in the pressurizing chambers 116 can be eased by slowly supplying ink thereto at the second step of operation.

Figure 5:
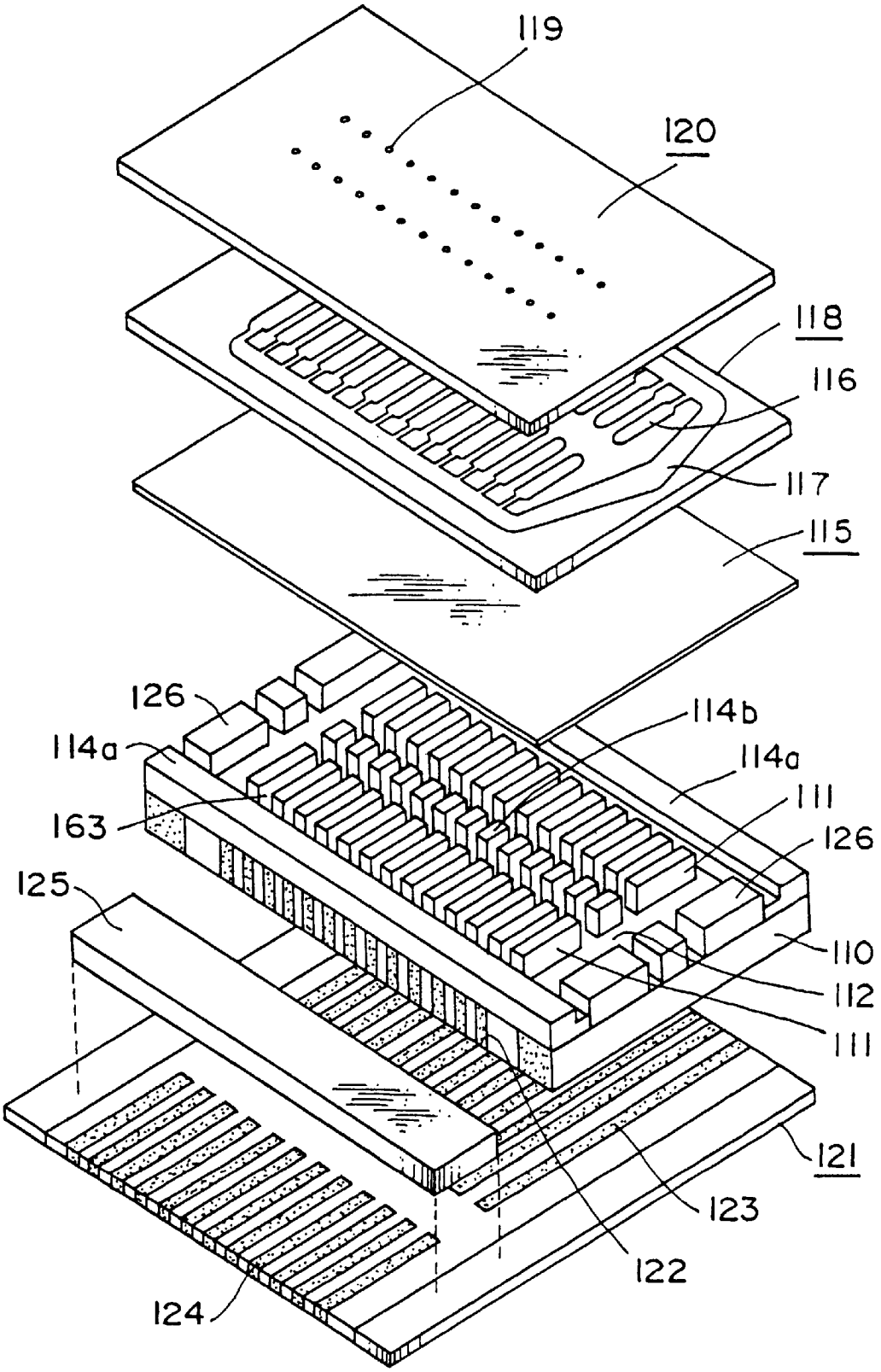
FIG. 5 is an exploded perspective view of an ink-jet head showing a structure thereof according to a second embodiment of the present invention.
Figure 6:
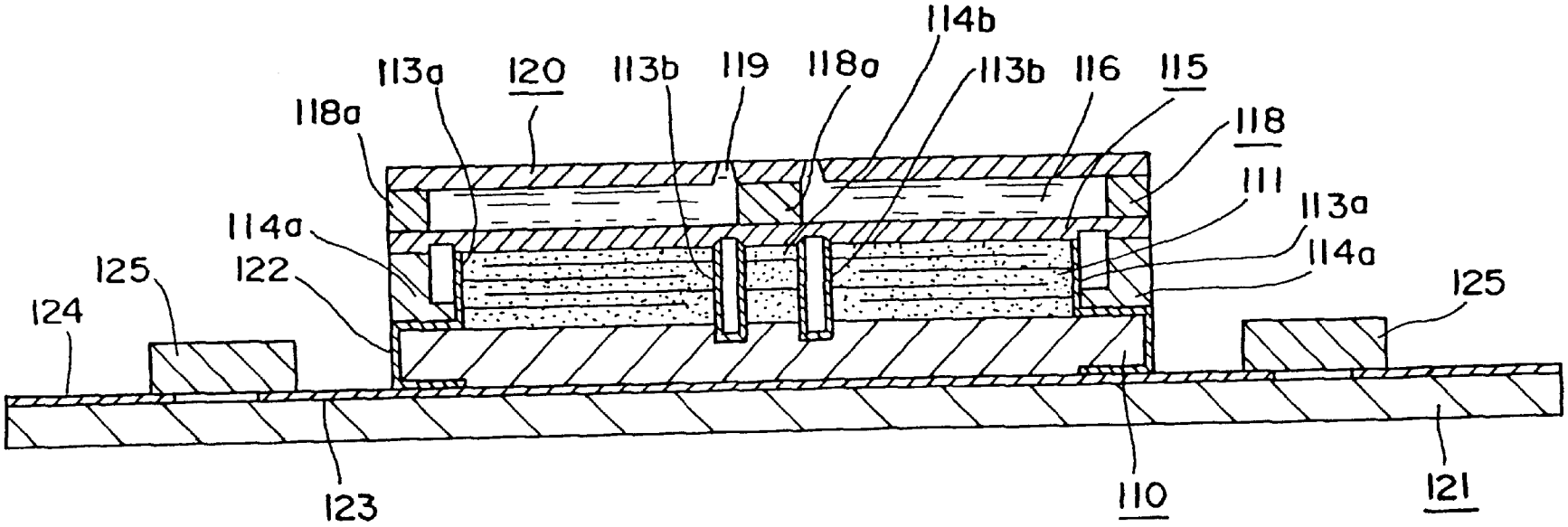
FIG. 6 is a front elevational cross-sectional view of an ink-jet head showing the structure thereof according to the second embodiment of the present invention.

FIGS. 5 and 6 show an ink-jet head according to the second embodiment of the present invention, wherein FIG. 5 is an exploded perspective view and FIG. 6 is a front elevational cross-sectional view. The second embodiment of the present invention is decried hereinafter, alternately referring to FIGS. 5 and 6.

As shown in FIGS. 5 and 6, a pair of laminated piezoelectric actuators 111 are arranged in series on the base plate 110 made of ceramic etc. The plural pairs of laminated piezoelectric actuators 111 are arranged in the longitudinal direction, thereby forming a matrix laminated piezoelectric actuator unit 112. The laminated piezoelectric actuator 111 is formed by alternately laminating plate-shaped piezoelectric material layers of piezoelectric ceramic made of a compound of lead zirconia and lead titanium and the conductive material layers of silver-paradium and baking the same.

As shown in FIG. 6, the driving collective electrodes 113*a* made of thin films of gold (Au) formed by the thin film forming means such as evaporation, etc., on the outer end surfaces of the laminated piezoelectric actuators 111, and the common collective electrode 113*b* is formed at the other end portions thereof by using a similar means as well.

As shown in FIGS. 5 and 6, the supports 114*a* made of ceramic are bonded onto the both end portions of the base plate 110 so that the upper surfaces of the supports 114*a* are on the same plane as the upper surfaces of the laminated piezoelectric actuators 111. Similarly, the supports 114*b* made of ceramic are also formed between the pairs of laminated piezoelectric actuators 111.

A metal diaphragm 115 is bonded to the upper surfaces of the laminated piezoelectric actuators 111 and the supports 114*a* and 114*b*.

Then, a metal flow path plate 118 is bonded onto the diaphragm 115. A plurality of pressurizing chambers 116 and a common ink flow path 117 which communicate with an unillustrated external ink tank are formed on the flow path plate 118. Each pressurizing chamber and its corresponding laminated piezoelectric actuator 111 are disposed above and under the diaphragm 115 respectively to confront each other through the diaphragm 115.

Hereupon, the diaphragm 115 is fixedly clamped by the supports 114*a* and 114*b* of the matrix laminated piezoelectric actuator unit 112 and the partitions 118*a* of the flow path plate 118.

Furthermore, a metal nozzle plate 120 having the nozzle holes 119 is bonded to the upper surface of the flow path plate 118. Each nozzle hole 119 communicates with its corresponding pressurizing chamber 116.

The wire patterns 123 are formed on a circuit substrate 121 at the pitch equal to the pitch of arranging the laminated piezoelectric actuators 111. On the other hand, the wire patterns 122 which are electrically connected to the driving collective electrodes 113*a* and the common collective electrode 113*b* are formed on the base plate 110. These wire patterns 123 and the wire patterns 122 are bonded together with a conductive adhesive.

Furthermore, the driving ICs 125 for driving the laminated piezoelectric actuators 111 by applying voltage thereto are mounted on the circuit substrate 121. The driving ICs 125 are electrically connected to the wire patterns 123 and the wires 124.

When an external signal is input to the wires 124, the driving ICs 125 are operated to apply voltage between the driving collective electrodes 113*a* of the laminated piezoelectric actuator 111 and the common collective electrode 113*b* thereof through the wire patterns 123 and the wire patterns 122 and to generate an electric field in the plate-shaped piezoelectric material of the laminated piezoelectric actuator 111. This electric field deforms the plate-shaped piezoelectric material in the direction of thickness ($d_{33}$ direction), the plate-shaped piezoelectric material having been polarized into the direction of the electric field.

In this way, the laminated piezoelectric actuator 111 is extended in the direction of thickness ($d_{33}$ direction). At the same time, the laminated piezoelectric actuator 111 is also contracted in the direction ($d_{31}$ direction) perpendicular thereto. Therefore, it is preferable to provide small gaps between the laminated piezoelectric actuators 111 and the supports 114*a* adjacent thereto, or bond them together with an elastic bonding material. Such a structure prevents the laminated piezoelectric actuator 111 from being restricted in the direction perpendicular to that of thickness and from causing deformation loss in the thickness direction.

Although it is not illustrated in detail in the drawing, the laminated piezoelectric actuators 126 and 126 located at the longitudinal end portions of the base plate 110 shown in FIG. 5 are not used for driving the diaphragm 115, but for electrically connecting the common collective electrode 113*b* shown in FIG. 1 to the wire patterns 122 on the base plate 110, so that an internal electrode to be electrically connected to the common collective electrode 113*b* is formed in each of the laminated piezoelectric actuators 126.

The material forming each member is not limited to the above ones. That is, the base plate 110, the supports 114*a* and 114*b* may be, for example, made of glass, if they are insulating members. The diaphragm 115, the flow path plate 118, and the nozzle plate 120 may be made of plastics, etc.

As described above, the materials for forming the base plate 110, the laminated piezoelectric actuator 111, the diaphragm 115, the flow path plate 118, and the nozzle plate 120 can be arbitrarily selected, but the materials described above can minimize the deformation of members caused by the difference in thermal expansion between them, since they have the substantially same coefficient of linear expansion, as the result, the performance of ejecting the ink-jet head remains constant even if the temperature changes.

Moreover, the base plate 110, the supports 114*a* and 114*b* may be integrally formed by utilizing a portion of piezoelectric material of the laminated piezoelectric actuator.

Furthermore, the supports 114*b*, which have the function of firmly fixing the diaphragm 115 and the flow path plate 118 together, may be omitted if the flow path plate 118 has sufficient high rigidity.

The partitions 118*a* provided between adjacent pressurizing chambers 116 in the flow path plate 118 are bonded to the upper surface of the diaphragm 115, while the opposite surface (lower surface) thereof contacts the grooves formed between the laminated piezoelectric actuators 111. Accordingly, when the diaphragm 115 and the flow path plate 118 are bonded to each other with a bonding material, etc., it is preferable to first bond the diaphragm 115 and the flow path plate 118 together, and then bond the bonded diaphragm 115 and the flow path plate 118 to the laminated piezoelectric actuators 111, the supports 114*a*, and 114*b* by pushing them one after another. In this way, it is possible to push the diaphragm 115 onto the laminated piezoelectric actuators 111 while supporting the diaphragm 115 with a jig, etc. inserted in the pressurizing chambers 116 formed by making holes on the flow path plate 118.

Furthermore, when the diaphragm 115 is clamped by the partitions 118*a* of the flow path plate 118 and the supports 114*a*, it can be firmly fixed, so that the diaphragm 115 stably functions as an elastic body. If the flow path plate 118 can be firmly bonded to the diaphragm 115 to support the same stably, the supports 114*a* and the flow path plate 118 may be directly bonded to each other without interposing the diaphragm 115 therebetween.

Since the structure of laminating the nozzle plate 120 on the flow path plate 118 can bond them together with a large surface area, it does not matter even if the boding material is squeezed out of the nozzle holes 119. As the result, there is no need of strict requirement of bonding quality to facilitate manufacturing a product.

Furthermore, since the nozzle plate 120 can secure a large surface area, it is easy to mount thereon the cap mechanism for securing the quality of menisci, i.e., the liquid levels in the nozzle holes 119 and the suction mechanism for removing the ink which blocks the nozzle holes 119.

According to the embodiment experimented by the inventor, it was possible to provide a laminated piezoelectric actuator 111 which is as small as about 3 mm in length and 0.5 mm in thickness, and which has high rigidity and high frequency. As the result, the continuous inkejecting performance was improved.

The laminated piezoelectric actuator 111 has high rigidity to be less liable to be broken, and moreover arranging the common electrode at the central portion thereof and driving electrodes at the outer end faces thereof facilitates providing electrical connection thereto with the minimum space, so as to increase the density of mounting the laminated piezoelectric actuator 111 on a plane.

Furthermore, since the supports 114*a* are arranged on the end surfaces of the laminated piezoelectric actuators 111 to bond the base plate 110 and the flow path plate 118, even if each laminated piezoelectric actuator 111 is individually driven its reactive force and pressure generated thereby in its corresponding pressurizing chamber 116 do not cause pressure loss in the pressurizing chamber 116 by changing the distance between the base plate 110 and the flow path plate 118 or do not generate interference between the pressurizing chambers 116 by deforming the base plate 110 and the flow path plate 118.

Furthermore, since the diaphragm 115 is fixedly clamped by the supports 114*a* and 114*b* and the partitions 118*a* of the flow path plate 118, the oscillation system of the diaphragm 115 becomes stable and excessive oscillation is not generated even if the pressurizing chamber 116 is pushed strongly by the laminated piezoelectric actuator 111, so that it has excellent efficiency and there occurs little interference between the adjacent pressurizing chambers 116.

Although it is not described in detail in the structure set forth above, using the uppermost plate-shaped piezoelectric material layer of the laminated piezoelectric actuator 111 as a dummy layer which does not function, facilitates flattening the laminated piezoelectric actuator 111 and the supports 114*a* and 114*b* by surface grinding, etc. and consequently connecting the diaphragm 115 thereto with high accuracy and with no gaps therebetween.

Furthermore, if the lowermost plate-shaped piezoelectric material layer of the laminated piezoelectric actuator 111 is made of a dummy layer, which does not function, even if the laminated piezoelectric actuator 111 is deformed in the $d_{31}$ direction, the dummy layer can absorb the deformation to ease the stress in the joint surface between the base plate 110 and the laminated piezoelectric actuator 111.

The ink-ejecting operation of the ink-jet head set forth above is described hereinafter mainly with reference to FIG. 6.

Firstly, at a first step of operation, voltage is applied between the driving collective electrode 113*a* and the common collective electrode 113*b* to generate an electric field in the plate-shaped piezoelectric material in the direction of polarization and to gradually extend the laminated piezoelectric actuator 111 in the direction of thickness ($d_{33}$ direction).

The capacity of the pressurizing chamber 116 is reduced in advance by this operation of pushing the diaphragm 115 into the pressurizing chamber 116. At this time, the laminated piezoelectric actuator 111 is sufficiently slowly driven not to eject the ink inside the pressurizing chamber 116 via the nozzle hole 119.

Then the operation proceeds to the second step, wherein the electric field generated in the preceding step is gradually weakened to reduce the displacement of the laminated piezoelectric actuator 111. This operation increases the capacity of the pressurizing chamber 116, compared with the operation of the first step so as to supply ink to the pressurizing chamber 116 through the common ink flow path 117 as shown in FIG. 5.

Successively, at a third step of operation, an electric field is abruptly generated in the plate-shaped piezoelectric material in the direction of polarization to greatly extend the laminated piezoelectric actuator 111 in the direction of thickness. At this time, the pressure in the pressurizing chamber 116 is abruptly increased to eject the ink which has filled the pressurizing chamber 116 via the nozzle hole 119.

Finally, at the fourth step, voltage applied to the laminated piezoelectric actuator 111 is reduced until it becomes to the same level as at the first step. The fourth step of operation may be omitted by making the voltage applied to the laminated piezoelectric actuator 111 at the first step equal to that at the third step.

According to such a driving method, since an electric field is constantly applied to the laminated piezoelectric actuator 111 in the direction same as that of polarization, there occurs no inverted polarization which weakens the polarization of the laminated piezoelectric actuator 111. Moreover, since the oscillation of liquid surfaces (menisci) in the nozzle holes 119 following that of ink generated in the pressurizing chambers 116 can be eased by gradually supplying ink at the second step of operation, it is possible to uniform the ejecting speed or diameter of ink droplets even if the laminated piezoelectric actuator 111 is driven with various frequencies.

The method of manufacturing the laminated piezoelectric actuator unit 112 in the ink-jet head set forth above is described hereinafter, with reference to FIG. 3A, FIG. 3B, FIG. 3C and FIG. 7.

The manufacturing method of the piezoelectric element block 150 shown in FIGS. 3A to 3C is substantially identical to that of the laminated piezoelectric actuator unit 112, according to the first embodiment described above.

That is, as shown in FIG. 3A, the first conductive material layer 131 is formed by the printing method on a first green sheet which is made of piezoelectric ceramic and is to be the plate-shaped piezoelectric material layer 130. At this time, the central portion of the plate-shaped piezoelectric material layer 130 remains uncoated with the first conductive material layer 131 so as to be the first exposed portion 130*a*.

Then, as shown in FIG. 3B, a second green sheet as the plate-shaped piezoelectric material layer 140 is laminated on the first conductive material layer 131 and the second conductive material layer 141 is formed by the printing method on the upper surface of the plate-shaped piezoelectric material layer 140. At this time, the both end surfaces of the plate-shaped piezoelectric material layer 140 remains uncoated with the second conductive material layer 141 so as to be the second exposed portions 140*a*.

The piezoelectric element block 150 as shown in FIG. 3C is formed by laminating the green sheets one after another for forming the plate-shaped piezoelectric material layers and the conductive material layers, and then applying the pressurized sintering process to them.

Figure 7:
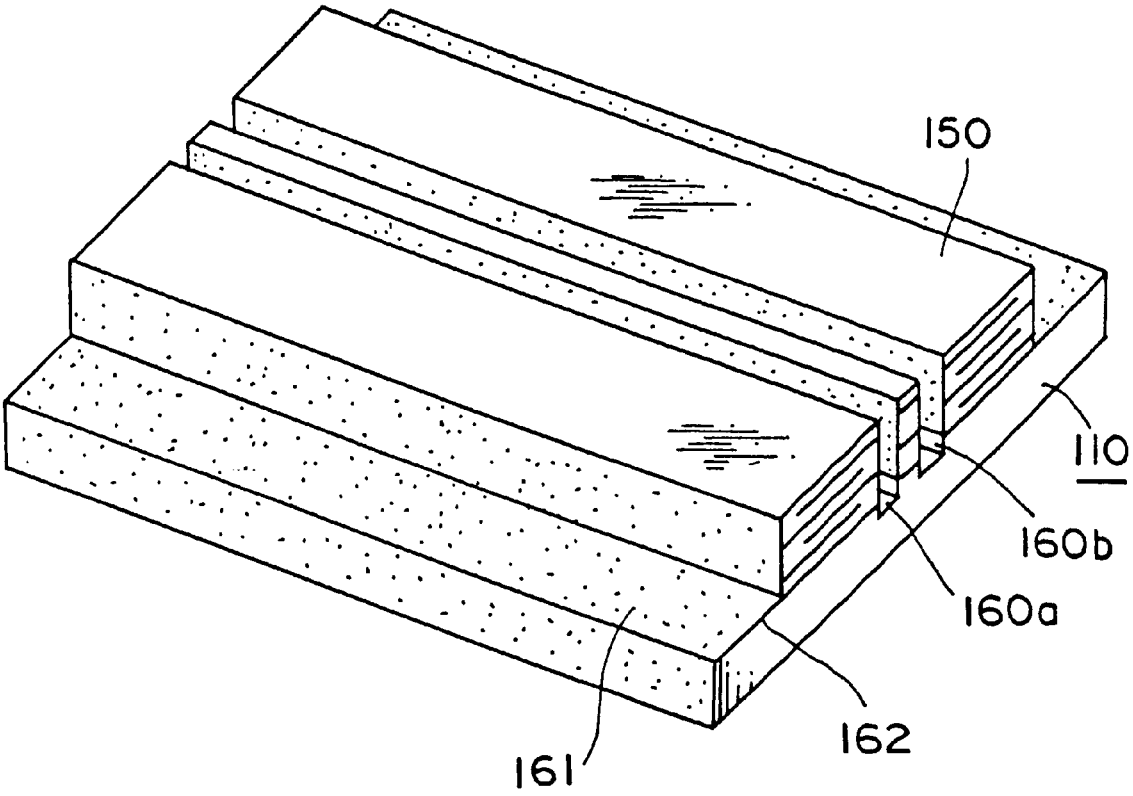
FIG. 7 is a perspective view of a laminated piezoelectric actuator constituting the ink-jet head showing a method of manufacturing the same according to the second embodiment of the present invention.

Then, as shown in FIG. 7, the piezoelectric element block 150 is bonded to the base plate 110, and successively the first slits 160*a* and 160*b* reaching the base plate 110 are formed in the piezoelectric element block 150 by using a cutting tool such as a diamond cutter, etc.

Thereafter a thin film of gold (Au) is formed all over the piezoelectric element block 150 and the base plate 110 by using the thin film forming means such as vacuum evaporation, and the electrode film 161 is formed on the upper surface of the base plate 110, on the end surfaces of the piezoelectric element block 150 and on the inner surfaces of the first slits 160*a* and 160*b*.

Then, the electrode film 161 is removed from the upper surface of the piezoelectric element block 150 or from other unnecessary surfaces by surface grinding, etc. so as to form the laminated piezoelectric actuator block 162 as shown in FIG. 4.

The second slits 163 (not shown in FIG. 7) are formed on the formed laminated piezoelectric actuator block 162 in the direction substantially perpendicular to the first slits 160*a* and 160*b* by using a diamond cutter, etc. The second slits 163 reach the base plate 110 but are shallower than the first slits 160*a* and 160*b*. Successively forming the second slits 163 at a given pitch completes manufacturing the laminated piezoelectric actuator 111.

At the manufacturing step as described above, the electrode film 161 shown in FIG. 7 is divided into a plurality of patterns so as to individually drive each laminated piezoelectric actuator 111.

Then as shown in FIG. 5, the supports 114*a* are bonded onto the base plate 110 and the upper surfaces of the laminated piezoelectric actuators 111 and the supports 114*a* and 114*b* are subjected to surface grinding concurrently.

The step of surface grinding and the step of forming the second slits 163 as set forth above may be reversed in order.

According to the structure of the ink-jet head and the method of manufacturing the laminated piezoelectric actuator 111, it is possible to easily form the electrical connecting structure for driving the laminated piezoelectric actuator 111 by using the thin film forming means and grinding.

Moreover, owing to its structure, the projecting portions of the laminated piezoelectric actuator 111 are small, so that a failure such as breakage hardly occurs. Further, since it comprises no hard manufacturing step, each member can be formed with high accuracy, and since it can be easily assembled by laminating members and bonding them together, the manufacturing cost is low.

An ink-jet head according to a third embodiment of the present invention is described hereinafter.

The ink-jet head according to the third embodiment of the present invention has a structure in which the arrangement of the nozzle holes 119 and the laminated piezoelectric actuators 111 is changed in the ink-jet head described in the first and second embodiments. Accordingly, other portions except those described above are substantially identical to those of the first and second embodiments, so that the description thereof is omitted properly.

Figure 8:
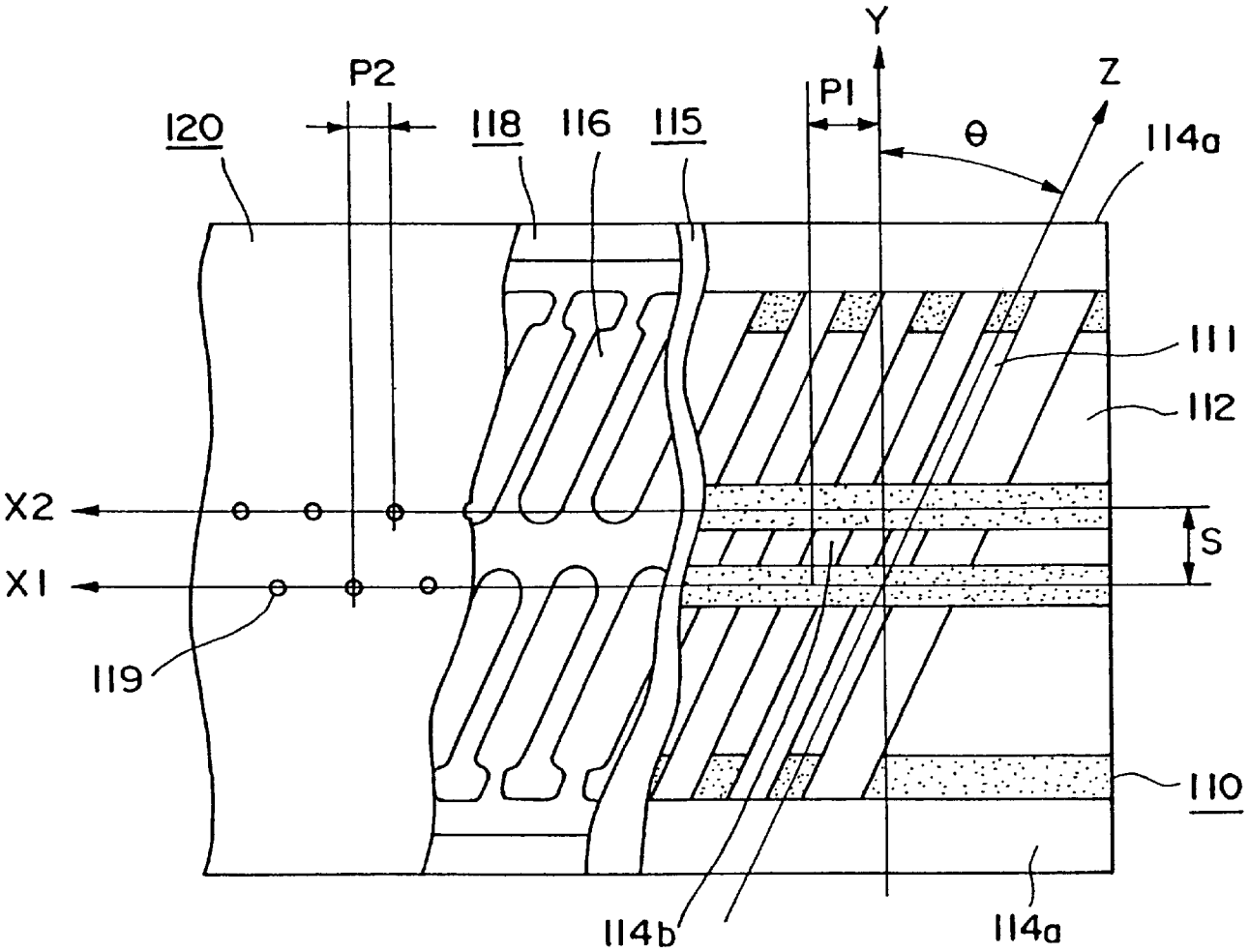
FIG. 8 is a partially cut plan view of an ink-jet head according to a third embodiment of the present invention.

FIG. 8 is a partially cut plan view showing the nozzle plate 120, the flow path plate 118, the diaphragm 115 and the laminated piezoelectric actuator unit 112.

In FIG. 8, the axes denoted with X1 and X2 are the ones crossing the nozzle holes 119 provided on the nozzle plate 120, and showing the arranging direction of the nozzle holes 119. The axes denoted with Y is an axis crossing the axes X1 and X2 at right angles on the nozzle plate 120.

According to this embodiment, the pairs of laminated piezoelectric actuators 111 and 111 are arranged in series, each laminated piezoelectric actuator 111 being disposed along an axis Z inclined by θ° relative to the axis Y.

Moreover, plural pairs of the laminated piezoelectric actuators 111 are arranged in series in the direction of the axes X1 and X2 with arranging intervals of P1.

Each of a plurality of pressurizing chambers 116 formed in the flow path plate 118 is also disposed in parallel to the axis Z inclined by θ° relative to the axis Y corresponding to each laminated piezoelectric actuator 111.

The nozzle plate 120 comprises the nozzle holes 119 each communicating with its corresponding pressurizing chamber 116.

Hereupon, the nozzle holes 119 on the axis X1 and those on the axis X2 are both arranged in the direction of the axes at the pitch of P1. Supposing that the x-component of distance between a nozzle hole 119 on the axis X1 and its neighboring nozzle hole 119 on the axis X2 is P2 and the distance between the axes X1 and X2 is S, the nozzle holes 119 are disposed to establish the expression:

$$P2=S\times\tan\theta=P½$$

When the ink-jet head having such a structure is moved in the axis Y direction in FIG. 8 relative to a printing medium such as paper etc. for printing characters, the arranging pitch of the nozzle holes 119 in the axis X1 (X2) direction becomes ½ compared with that of the first and second embodiments, so that printed pixels are doubled in density, and that an image with extremely high quality can be obtained.

According to the embodiment experimented by the inventor, the arranging pitch of the nozzle holes 119 could be set to as high as 300 dpi by forming grooves on the laminated piezoelectric body bonded to the base plate 110 at the pitch of 150 dpi. At this time, the inclined angle θ was very small on the order of 0.03 radian, so that practically the shape of the laminated piezoelectric actuators 111 or the pressurizing chambers 116 did not deviate from a rectangular form to such a parallelogram as illustrated in FIG. 8.

Figure 9:
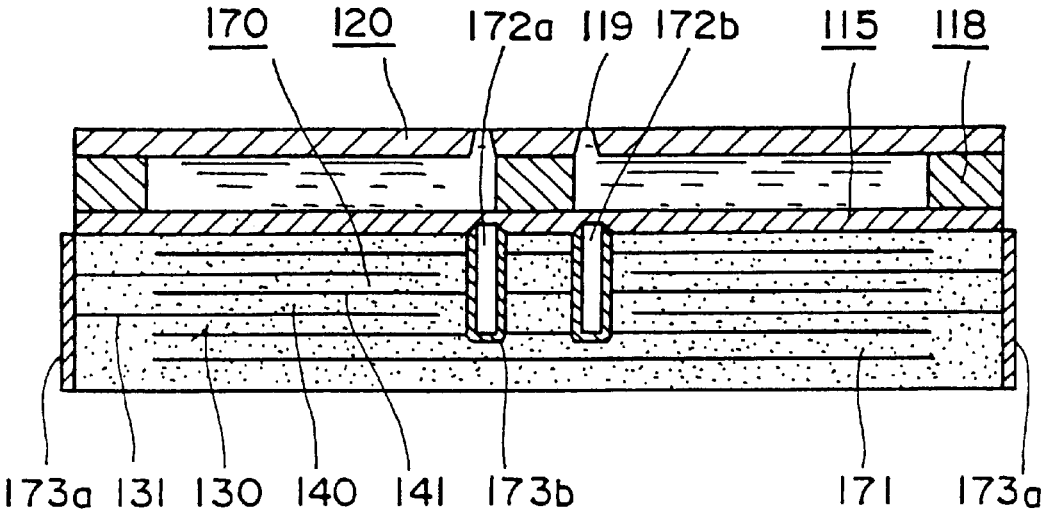
FIG. 9 is a front elevational cross-sectional view of an ink-jet head showing a structure thereof according to a fourth embodiment of the present invention.

A fourth embodiment of the present invention is described hereinafter mainly with reference to FIG. 9.

The structure of the ink-jet head according to this embodiment is identical to that of the second embodiment set forth above excluding a laminated piezoelectric actuator unit 170 described later.

The laminated piezoelectric actuator unit 170 is described hereinafter according to the manufacturing steps thereof.

A laminated piezoelectric body 171 is formed by laminating the plate-shaped piezoelectric material layers and conductive material layers one after another and subjecting the thus laminated material layers to pressurized sintering process, same as to the second embodiment.

First slits 172*a* and 172*b* are formed at the central portion of the laminated piezoelectric body 171, and the driving collective electrodes 173*a* and common collective electrodes 173*b* are formed on both end surfaces of the laminated piezoelectric body 171 and inside the first slits 172*a* and 172*b*, respectively.

The second slits similar to the second slits 163 (see FIG. 5) in the second embodiment are formed in the thus formed laminated piezoelectric body 171 in the direction substantially perpendicular to the first slits 172*a* and 172*b* at a given pitch, thereby completing the laminated piezoelectric actuator unit 170.

Moreover, the driving collective electrodes 173*a* are divided from each other by forming slits at the same pitch as that of the second slits set forth above to serve as individual driving electrodes corresponding to the respective laminated piezoelectric blocks 171.

Then, the diaphragm 115, the flow path plate 118, and the nozzle plate 120 are laminated and bonded together to form an ink-jet head, same as to the second embodiment.

The feature of this embodiment resides in forming the base plate 110 and the supports 114*a* and 114*b* of the ink-jet head of the second embodiment from the laminated piezoelectric actuator itself, instead of forming them as another members.

That is, one of the pairs of the first conductive material layers 131 and the second conductive material layers 141 confronting each other for driving each plate-shaped piezoelectric material layer 130 and each plate-shaped piezoelectric material layer 140 does not exist at the bottom portion, the outer end portions, and around the central portion of the laminated piezoelectric blocks 171. As the result, these portions do not deform even if voltage is applied thereto. So, the bottom portion and the outer end portions and central portion of the laminated piezoelectric blocks 171 are utilized as the base plate and the supports, respectively, in order to reduce the number of members.

Therefore, according to the fourth embodiment, the cost of members and the number of manufacturing steps can be reduced so that the ink-jet head can be manufactured with ease.

The fifth embodiment of the present invention is described hereinafter with reference to FIG. 10.

The ink-jet head according to this embodiment is also similar to those of the first to fourth embodiments set forth above excluding a laminated piezoelectric actuator unit 180 described later.

The ink-jet head of this embodiment has a structure in which the connecting structure of the laminated piezoelectric actuators, the diaphragm and the flow path plate in the first to fourth embodiments set forth above is modified.

Figure 10:
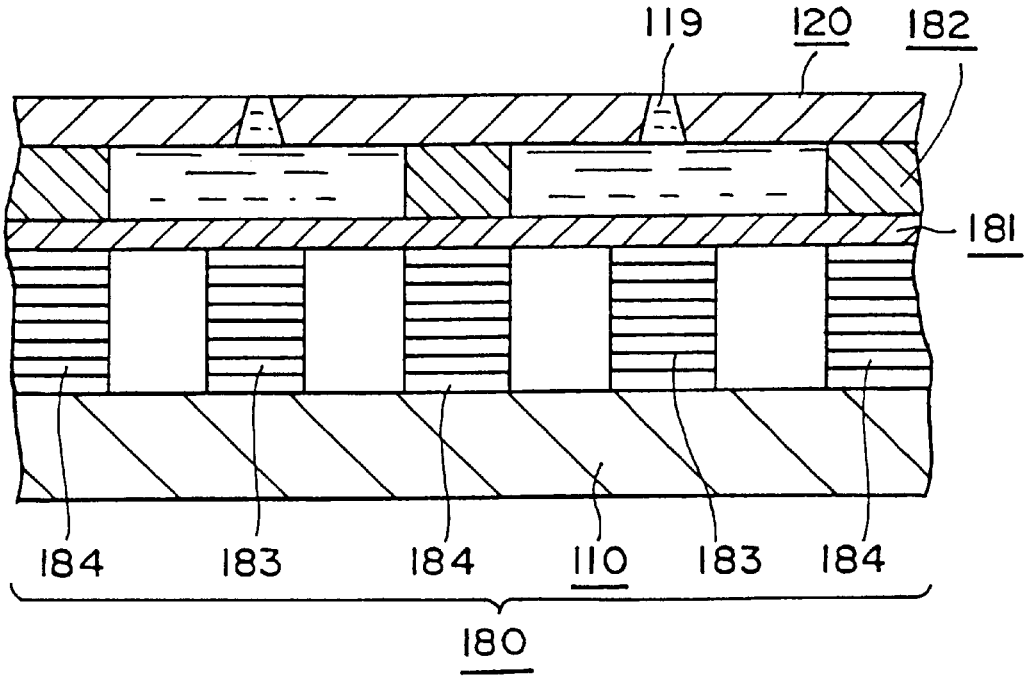
FIG. 10 is an enlarged front elevational cross-sectional view of an ink-jet head according to a fifth embodiment of the present invention.

That is, as shown in FIG. 10, a plurality of laminated piezoelectric actuator units 180 are arranged in a row at a given pitch, wherein rows of driven actuators 183 and rows of undriven actuators 184 are alternately disposed, the undriven actuators 184 arranged every other rows being utilized as supports.

A diaphragm 181 is connected to the upper end surfaces of the driven actuators 183 and the undriven actuators 184 serving as supports, and further a flow path plate 182 is connected to the upper surface of the diaphragm 181. Hereupon, the diaphragm 181 is clamped by the undriven actuators-184 and the partitions of the flow path plate 182.

Furthermore, the nozzle plate 120 is bonded to the upper end surface of the flow path plate 182.

Such a structure makes the supporting condition of the diaphragm 181 constant, so that it is possible to prevent the unevenness of inkejecting performance and interference between the adjacent pressurizing chambers.

An ink-jet head according to a sixth embodiment of the present invention is described hereinafter with reference to FIGS. 11 and 12.

The ink-jet head according to the sixth and later embodiments have substantially same structure with regard to the laminated piezoelectric actuator unit as that of the ink-jet head according to the first to fifth embodiments set forth above, but the former are essentially different from the latter in the structure of pressurizing chambers and the principle of ejecting ink.

That is, the ink-jet head according to the first to fifth embodiments had a structure in which a laminated piezoelectric actuator provided outside a pressurizing chamber pushes the same to eject ink droplets therefrom, but in the ink-jet head according to the sixth and later embodiments, the pressurizing chamber is formed in the laminated piezoelectric actuator.

Therefore, the members are denoted with new numerals for explanation in drawings (FIGS. 11 to 18) wherein the sixth and later embodiments are shown.

Figure 11:
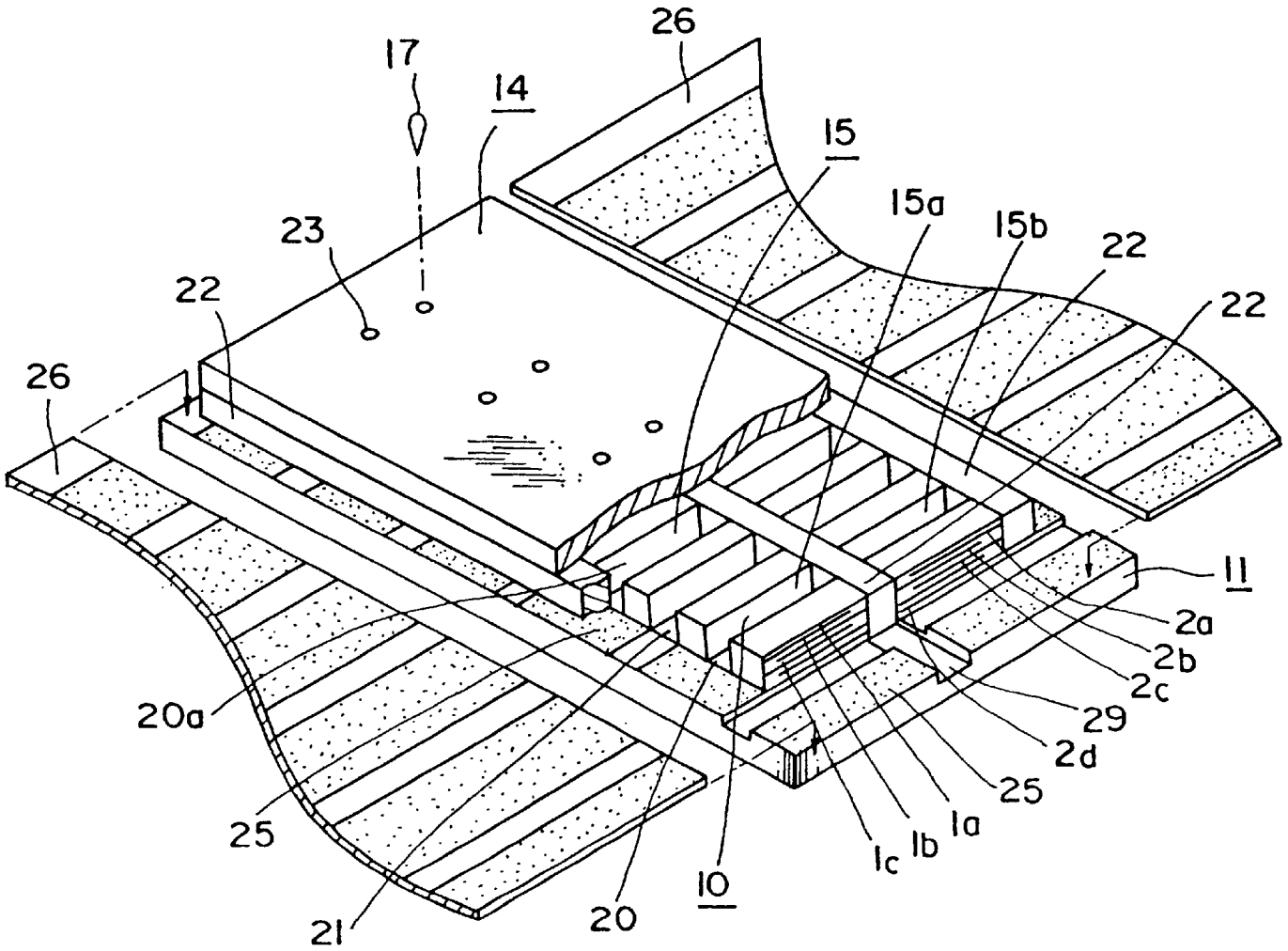
FIG. 11 is a perspective view of an ink-jet head showing a structure thereof according to a sixth embodiment of the present invention.
Figure 12:
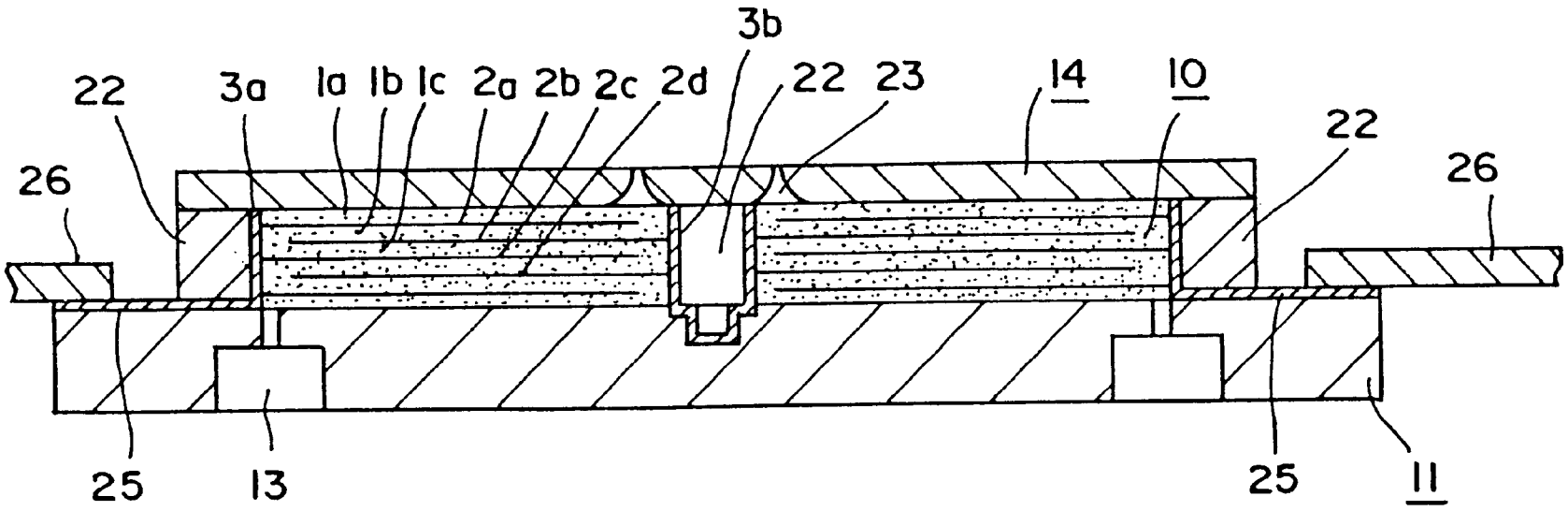
FIG. 12 is a front elevational cross-sectional view of the ink-jet head showing a structure thereof according to the sixth embodiment of the present invention.

As shown. in FIGS. 11 and 12, a first plate-shaped piezoelectric material layer 1*a* and a second plate-shaped piezoelectric material layer 1*b* are bonded together with a first conductive material layer 2*a* interposing therebetween. Further, the second plate-shaped piezoelectric material layer 1*b* and a third plate-shaped piezoelectric material layer 1*c* are bonded together with a second conductive material layer 2*b* interposing therebetween.

Hereupon, the first plate-shaped piezoelectric material layer 1*a* is polarized into the direction of thickness, while the second plate-shaped piezoelectric material layer 1*b* is polarized into the direction which is reverse to that of the first plate-shaped piezoelectric material layer 1*a*. The third plate-shaped piezoelectric material layer 1*c* is polarized into the direction which is reverse to that of the second plate-shaped piezoelectric material layer 1*b*.

Each of partitions 10 is formed by successively laminating the necessary number of conductive material layers and that of plate-shaped piezoelectric material layers in a similar structure.

A first collective electrode 3*a* made of thin gold (Au) film, etc. formed by using the thin film forming means such as the vacuum evaporation method is provided on the end surface of the partitions 10. The first conductive material layer 2*a*, a third conductive material layer 2*c*, etc. are electrically connected to the first collective electrode 3*a*.

On the other hand, a second collective electrode 3*b* is provided on the other end surfaces of the partitions 10 by using the means similar to that of the first collective electrode 3*a*, and the second conductive material layer 2*b*, a fourth conductive material layer 2*d*, etc. are electrically connected to the second collective electrode 3*b*.

When a voltage is applied between the first collective electrode 3*a* and the second collective electrode 3*b* in the ink-jet head having such a structure, it generates a potential difference between the conductive material layers to generate an electric field in the plate-shaped piezoelectric material layer in the direction of thickness. As the result, the partitions 10 function as piezoelectric element blocks.

A plurality of these partitions 10 are arranged in matrix on a base plate 11 on which an ink supply port 13 has an opening. These partitions 10 are bonded onto the base plate 11 with a bonding agent to form longitudinal gaps 20 and 21 and a lateral gap 29 between the partitions 10.

Furthermore, a sealing member 22 is fixed on the base plate 11 by bonding such that it contacts the longitudinal outer end surfaces of the partitions 10. A cover 14 covers the longitudinal gaps 20 and 21 and the upper surface of the sealing member 22 to form a plurality of pressurizing chambers 15 surrounded by these partitions 10, the sealing member 22 and the cover 14.

A plurality of nozzle holes 23 each communicating with its corresponding pressurizing chamber 15 are formed in the cover 14.

Wiring patterns 25 electrically connected to the collective electrodes 3*a* and 3*b* of the partitions 10 are provided on the upper surface of the base plate 11. These wiring patterns 25 are connected to flexible wiring plates 26, and an external driving voltage is applied to the collective electrodes 3*a* and 3*b* of the partitions 10 via these flexible wiring plates 26 and wiring patterns 25.

Although it is not shown in FIGS. 11 and 12, ink can be supplied to the ink supply port 13 from a common ink tank of an ink cartridge.

Although the ink supply port 13 is formed on the base plate 11 according to this embodiment, it may be formed in the sealing member 22, the cover 14 or the like.

In the ink-jet head describe above, the partitions 10 as laminated piezoelectric actuators are arranged in two rows so that the nozzle holes 23 can be opened in the direction of thickness to realize the high density of mounting the partitions 10. The partitions 10 may be also arranged in a row depending on their way of use.

The operation of the ink-jet head according to the embodiment set forth above is described hereinafter with reference to FIGS. 11 and 12.

When electric power is supplied to the first and second collective electrodes 3*a* and 3*b* from the flexible wiring plates 26 connected thereto by way of the wiring patterns 25, voltage is generated between the first conductive material layer 2*a* and the second conductive material layer 2*b*. An electric field is generated in the second plate-shaped piezoelectric material layer 1*b* in the thickness direction thereof.

The second plate-shaped piezoelectric material layer 1*b* is previously polarized into the direction opposite to that of the electric field in advance. As the result, the second plate-shaped piezoelectric material layer 1*b* is contracted in the thickness direction ($d_{33}$ direction) thereof.

Hereupon, supposing that the thickness of the second plate-shaped piezoelectric material layer 1*b* is t, the amount of deformation thereof is δt, voltage applied thereto is V and the piezoelectric strain coefficient in the thickness direction thereof is $d_{33}$, the following expression is established since strain is proportional to the strength of electric field:

$$\delta t/t = d_{33}\ V/t$$

$$\therefore \delta t = d_{33}\ V$$

That is, the above expression means that the amount of deformation is proportional to voltage, and does not depend on the thickness of piezoelectric material layer.

Each of the laminated piezoelectric material layers is deformed similarly to the second plate-shaped piezoelectric material layer 1*b*, so that the total deformation in the thickness direction is proportional to the number m of the laminated piezoelectric material layers, on both surfaces of which electrodes are formed, to be m×δt, thereby obtaining a large amount of deformation m times as much as that of a single layer.

Moreover, though it is smaller than the amount of deformation in the thickness direction ($d_{33}$ direction) set forth above, the partitions 10 made of piezoelectric material is also extended in the longitudinal direction ($d_{31}$ direction), thereby reducing the capacity of the pressurizing chambers 15 as well.

The deformation of the laminated piezoelectric material in the thickness direction ($d_{33}$ direction) set forth above generates a strong force, thereby reducing the capacity of the pressurizing chamber by S×m×δt, supposing that the cross section of the pressurizing chamber 15 is S. The reduction of capacity, i.e., the variation of volume generates pressure in the pressurizing chamber 15, which can eject an ink droplet 17 via the nozzle hole 23.

Forming an ink droplet 17 requires a given amount of variation in the capacity of the pressurizing chamber 15, but the ink-jet head according to the embodiment set forth above can obtain a sufficient amount of variation in capacity even by a single-layered piezoelectric element block. As the result, it can form an ink droplet 17 stable in size.

Furthermore in the ink-jet head according to the embodiment set forth above, the amount of deformation of a layer of piezoelectric element block can be multiplied by m, so that it is possible to make the cross section S of a pressurizing chamber by 1/m of the cross section in case of the single-layered piezoelectric element block, so that the pressurizing chamber can be made small.

As the result, it is possible to shorten the length of the pressurizing chamber, which is advantageous to supply ink as described hereinafter.

In order to successively forming the ink droplet 17, it is necessary to rapidly supply ink from the ink supply port 13 to the pressurizing chamber 15 as much as the ink droplet 17 ejected therefrom. In the embodiment set forth above, the ink supply port 13 is provided at an end portion of the pressurizing chamber 15 opposite to the nozzle hole 23.

Accordingly, it is preferable that the ink flow path formed in the pressurizing chamber 15 in the longitudinal direction thereof is small in flow resistance and short in length.

In the ink-jet head of this embodiment, the dimension of the partitions 10 each made of laminated piezoelectric element block in the thickness direction thereof, i.e., the height of the pressurizing chamber 15 depends on the thickness of the plate-shaped piezoelectric material layer and the number of laminated layers. The height of the pressurizing chamber 15 can be increased by increasing the number of plate-shaped piezoelectric material layers so as to increase the variation of capacity of the pressurizing chamber 15.

Basically, the generated pressure is proportional to [the variation of capacity]/[the capacity of the pressurizing chamber]. Therefore, the increased amount of capacity can be compensated by the variation of capacity, so that the ejecting force is not reduced.

The cross section of the pressurizing chamber 15 can be increased by increasing the height of the partitions 10. As the result, the flow resistance of ink flow path formed in the pressurizing chamber 15 can be made small, and moreover the ink flow path can be made short. Accordingly, it is possible to improve ink supply performance so as to successively form an ink droplet 17 stable in size, thereby improving the performance of successively ejecting the ink droplet 17.

Similar structure employing single-layer-type partitions cannot change the variation of capacity of the pressurizing chamber, but on the contrary increases the capacity of the pressurizing chamber following the increase of height of the pressurizing chamber so that the pressure generated therein is reduced.

In order to increase pressure generated therein, voltage applied thereto may be increased, but it is not practical that the voltage is increased further more than 150 V.

Furthermore, in the inkjet head according to the present embodiment, the piezoelectric element block is formed by laminating a plurality of plate-shaped piezoelectric material layers, so that the amount of deformation of the plate-shaped piezoelectric material layer can be amplified proportionally to the number of layers. As the result, it is possible to reduce the applied voltage necessary for obtaining a certain amount of deformation compared with a single-layered plate-shaped piezoelectric material so as to facilitate driving the piezoelectric element block at low voltage less than 50 V.

Furthermore, the largest feature of the ink-jet head according to this embodiment is that a plurality of pressurizing chambers 15 can be arranged in matrix on the base plate 11 to realize a two-dimensional arrangement. As the result, it is possible to form a pressurizing chamber 15*a* and a pressurizing chamber 15*b*, which are independent of each other in a longitudinal gap 21 as illustrated in FIG. 11.

In this way, it is possible to form a plurality of rows of nozzle holes 23 by arranging independent pressurizing chambers 15 in matrix on the base plate 11 and providing individual nozzle holes 23 each corresponding to each of the pressurizing chambers 15. As the result, it is possible to realize a multi-nozzle ink-jet head.

This feature occurs due to the making the partitions 10 of laminated plate-shaped piezoelectric material layers and the driving of the same to obtain a large amount of deformation. That is, since a large amount of deformation can be obtained, it becomes possible to miniaturize each pressurizing chamber 15 and consequently arrange a plurality of independent pressurizing chambers 15 in matrix on the base plate 11.

Although ink is ejected by contracting the piezoelectric element block according to the embodiments described above, it is also possible that the electric field is generated in the same direction as that of polarization of the plate-shaped piezoelectric material layers to extend the same in the thickness direction to increase the capacity of the pressurizing chambers 15, thereafter applying voltage is stopped to return the piezoelectric element block to its original state thereby generating pressure for ejecting ink.

In FIG. 11, the longitudinal gaps 20 serve as pressurizing chambers 15 which are filled with ink and the longitudinal gaps 21 adjacent thereto form dummy spaces which are not filled with ink.

It becomes possible to separately drive the adjacent pressurizing chambers 15, which the longitudinal gaps 20 and 20*a* constitute, by forming the dummy space which is not filled with ink therebetween.

As the result, it becomes possible to drive the pressurizing chambers 15 freely in time, for example, to eject ink inside the adjacent pressurizing chambers 15 simultaneously or with a time-lag therebetween.

In case the longitudinal gap 21 is not used as a dummy space which is not filled with ink, the partition 10 between the adjacent pressurizing chambers 15 is commonly used for driving the same. Accordingly, it is necessary to set the conditions that, when one of the pressurizing chambers 15 is driven, an ink droplet is not ejected from the other pressurizing chamber.

In concrete, it requires a troublesome setting such as preventing the partitions 10 from being displaced more than a given amount, selecting the timing for driving the partitions 10 so that ink can not be ejected synchronizing with the oscillation level of meniscus in the nozzle hole, or the like.

Since the longitudinal gap 21 serving as a dummy space is formed only for allowing the partitions of adjacent pressurizing chambers 15 to function independently, it may have a width enough to prevent the adjacent partitions 10 from being in contact with each other.

Narrowing the dimension of width of the longitudinal gap 21 forming a dummy space to its machining limit is effective in increasing the pitch of arranging the pressurizing chambers 15. Accordingly, it is possible to obtain a small head having the higher-density nozzle pitch.

The method of manufacturing the ink-jet head according to the embodiment set forth above is described with reference to FIGS. 13A, 13B, 13C, 14 and 15.

Figure 13A:
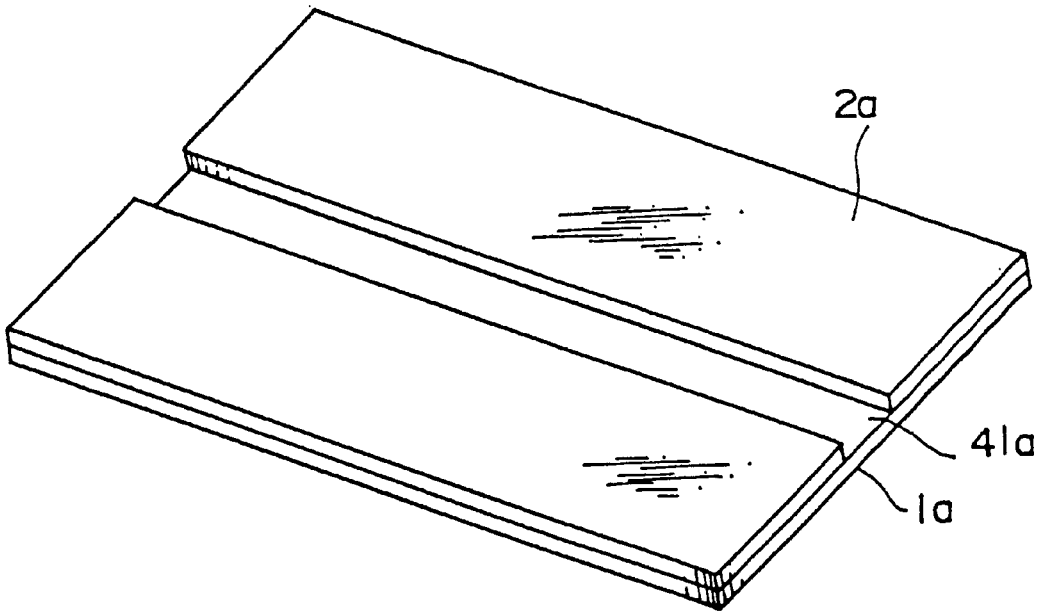
FIG. 13A is a perspective view of a piezoelectric element block of the ink-jet head showing the method of forming the same according to the sixth embodiment of the present invention.

Firstly, as shown in FIG. 13A, the first conductive material layer 2*a* is formed by the printing method on the upper surface of a first green sheet which is made of piezoelectric ceramic and is to be the first plate-shaped piezoelectric material layer 1*a*. At this time, the central surface portion 41*a* of the first plate-shaped piezoelectric material layer 1*a* remains uncoated with the first conductive material layer 2*a* to be in an exposed state.

Figure 13B:
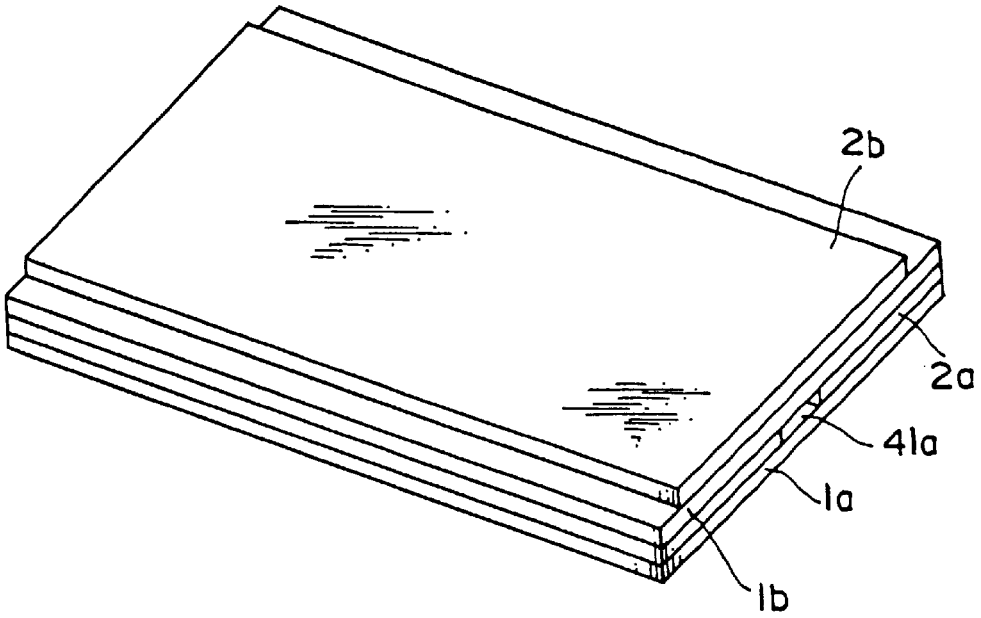
FIG. 13B is a perspective view of the piezoelectric element block of the ink-jet head showing the method of forming the same following the preceding drawing according to the sixth embodiment of the present invention.

Secondly, as shown in FIG. 13B, a new second green sheet to be the second plate-shaped piezoelectric material layer 1*b* is laminated on the first conductive material layer 2*a* and the second conductive material layer 2*b* is formed on the surface thereof by the printing method. At this time, both edge portions of the second plate-shaped piezoelectric material layer 1*b* remains uncoated with the second conductive material layer 2*b* to be exposed.

Figure 13C:
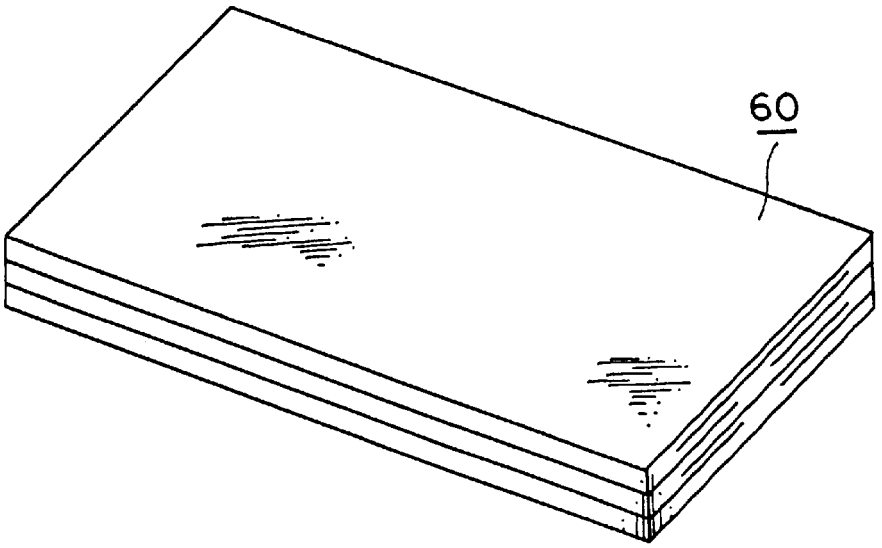
FIG. 13C is a perspective view of the piezoelectric element block of the ink-jet head showing the method of forming the same following the preceding drawing according to the sixth embodiment of the present invention.

In this way, it is possible to form a piezoelectric element block 60 as shown in FIG. 13C by alternately laminating a given number of green sheets one after another to be the plate-shaped piezoelectric material layer and conductive material layer and thereafter applying the pressurized sintering process to the same.

Figure 14:
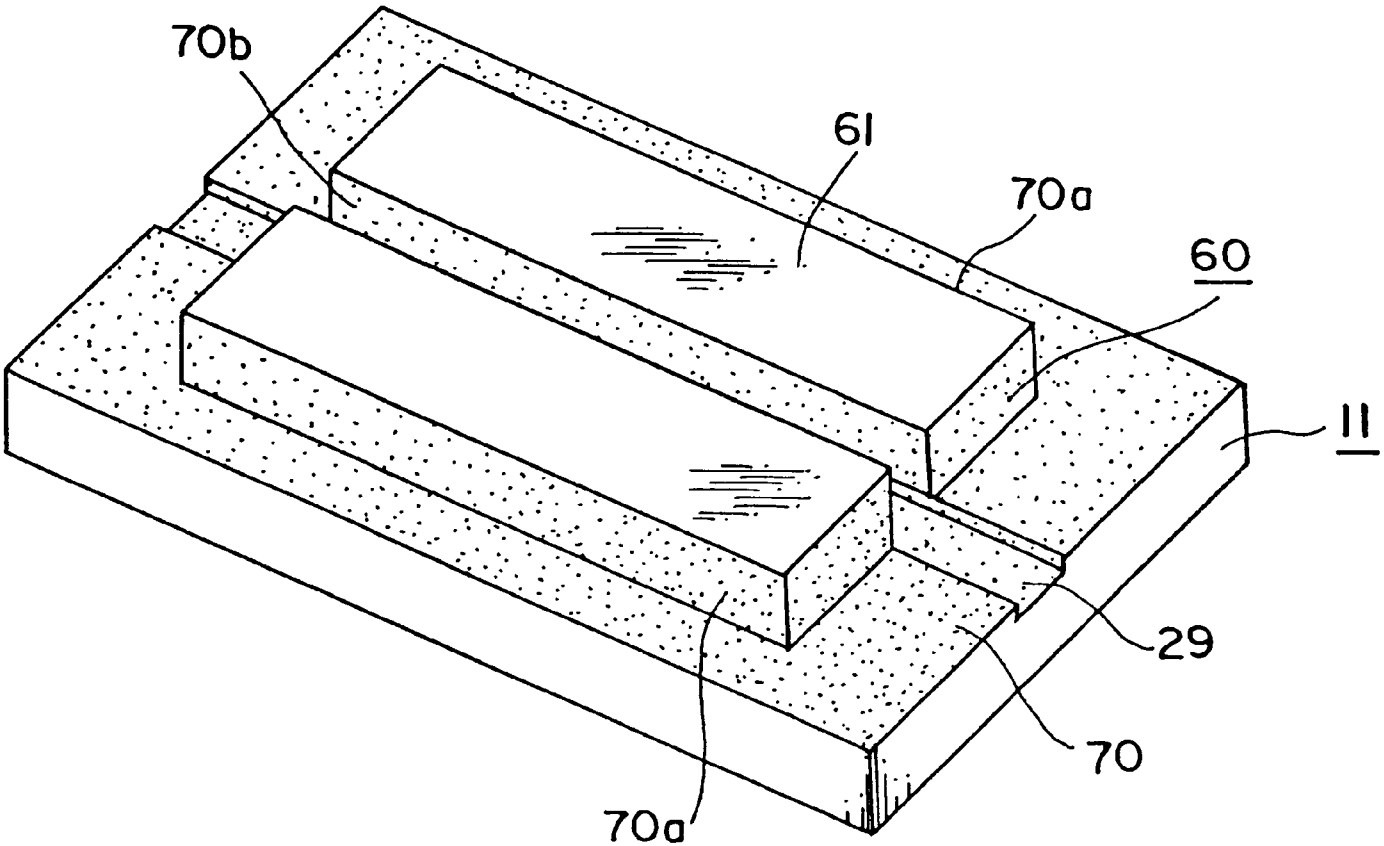
FIG. 14 is a perspective view of the piezoelectric element block of the ink-jet head showing the method of forming the same following the preceding drawing according to the sixth embodiment of the present invention.

Then, as shown in FIG. 14, the piezoelectric element block 60 is bonded to the upper surface of the base plate 11 made of glass material, etc.

Thereafter, a portion of the piezoelectric element block 60 and the base plate 11 is cut by using a cutting tool such as a diamond cutter, etc. to form the lateral gap 29.

Moreover, a thin film made of conductive material such as gold (Au) or the like is formed all over the piezoelectric element block 60 and the base plate 11 by way of vacuum evaporation, etc., while masking the upper surface 61 of the piezoelectric element block 60 to form an electrode 70.

At this time, the first conductive material layer 2*a*, the second conductive material layer 2*b*, etc. in the piezoelectric element block 60 are electrically connected to the electrode 70 formed on the side surfaces 70*a* and 70*b*.

Figure 15:
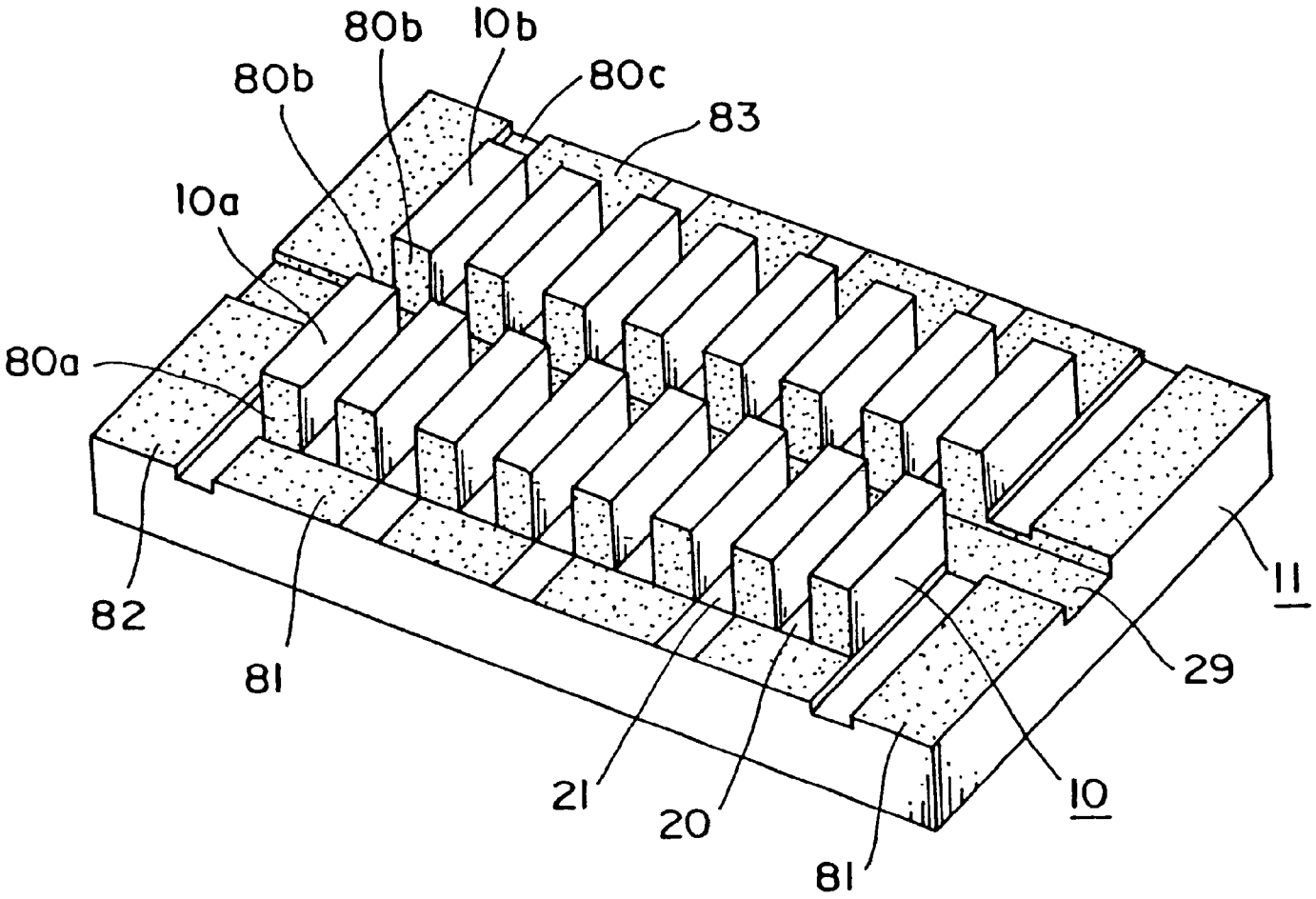
FIG. 15 is a perspective view of a laminated piezoelectric actuator of the ink-jet head showing a method of forming the same according to the sixth embodiment of the present invention.

Successively, as shown in FIG. 15, the piezoelectric element block 60 and a portion of the base plate 11 are cut by a cutting tool such as a diamond cutter, etc. in a direction perpendicular to the lateral gap 29. As the result, the partitions 10, the longitudinal gaps 20 and the longitudinal gaps 21 are formed to divide the piezoelectric element block 60 and the electrode 70.

Then, as shown in FIG. 11, the sealing member 22 is bonded to the end portions of the partitions 10 and the cover 14 which is made of glass material etc. and in which the nozzle holes 23 are formed is bonded onto the partitions 10 to form the pressurizing chambers 15.

According to the manufacturing method set forth above, as shown in FIG. 15, a first collective electrode 80*a*, a second collective electrode 80*b* and a third collective electrode 80*c*, to which each of conductive material for driving the piezoelectric element block is connected, can be easily formed at both end portions of each of the partitions 10.

Moreover, as shown in FIG. 15, providing the first collective electrodes 80*a* and the second collective electrodes 80*b* at both end portions of the partitions 10 in the first row, and providing the second collective electrodes 80*b* and the third collective electrodes 80*c* at both end portions of the partitions 10 in the second row are effective, since it facilitates electrical connection to external driving lines.

Furthermore, according to the manufacturing method set forth above, as shown in FIG. 15, wiring patterns 81 for supplying electric power to the first collective electrodes 80*a* can be formed on the base plate 11, and wiring patterns 82 for supplying electric power to the second collective electrodes 80*b* and wiring patters 83 for supplying electric power to the third collective electrodes 80*c* can be formed at the same time.

The structure in which wiring patterns 81, 82 and 83 are formed on the base plate 11 as shown in FIG. 15 has an effect to facilitate the electrical connection to the flexible wiring plates 26 shown in FIG. 11.

Hereupon, the second collective electrodes 80*b* serve as a common electrode for driving first-row partitions 10*a* and second-row partitions 10*b*. As the result, all the partitions 10 have the wiring patterns 82 as the common electrode, it is possible to reduce the number of electrical contacts between the flexible wiring plates 26 and the partitions 10.

Although the method of manufacturing the ink-jet head according to the sixth embodiment has been described above, the present invention is not limited to this structure.

For example, the base plate 11 is not limited to the glass material, but may be formed of material such as ceramic, plastics, or the like.

As for the cover 14, ceramic, plastic, and metal materials are applicable thereto except the glass material.

Although piezoelectric ceramic was employed as the plate-shaped piezoelectric material, an organic macromolecule piezoelectric film can be also employed.

No electrode is formed on the bonding surface between the partitions 10 and the base plate 11, and on the bonding surface between the partitions 10 and the cover 14. However, the plate-shaped piezoelectric material bonded to the base plate or the cover is also drivable by providing conductive material to form electrodes on the surfaces of the piezoelectric element block 60 where the same contacts the base plate or the cover.

Furthermore, although the vacuum evaporation method was employed in forming the collective electrodes, it is also possible to form the electrodes at the end surfaces of the piezoelectric element block by using the conductive coating to directly connect the collective electrodes on the piezoelectric element block to the flexible wiring plates.

Figure 16:
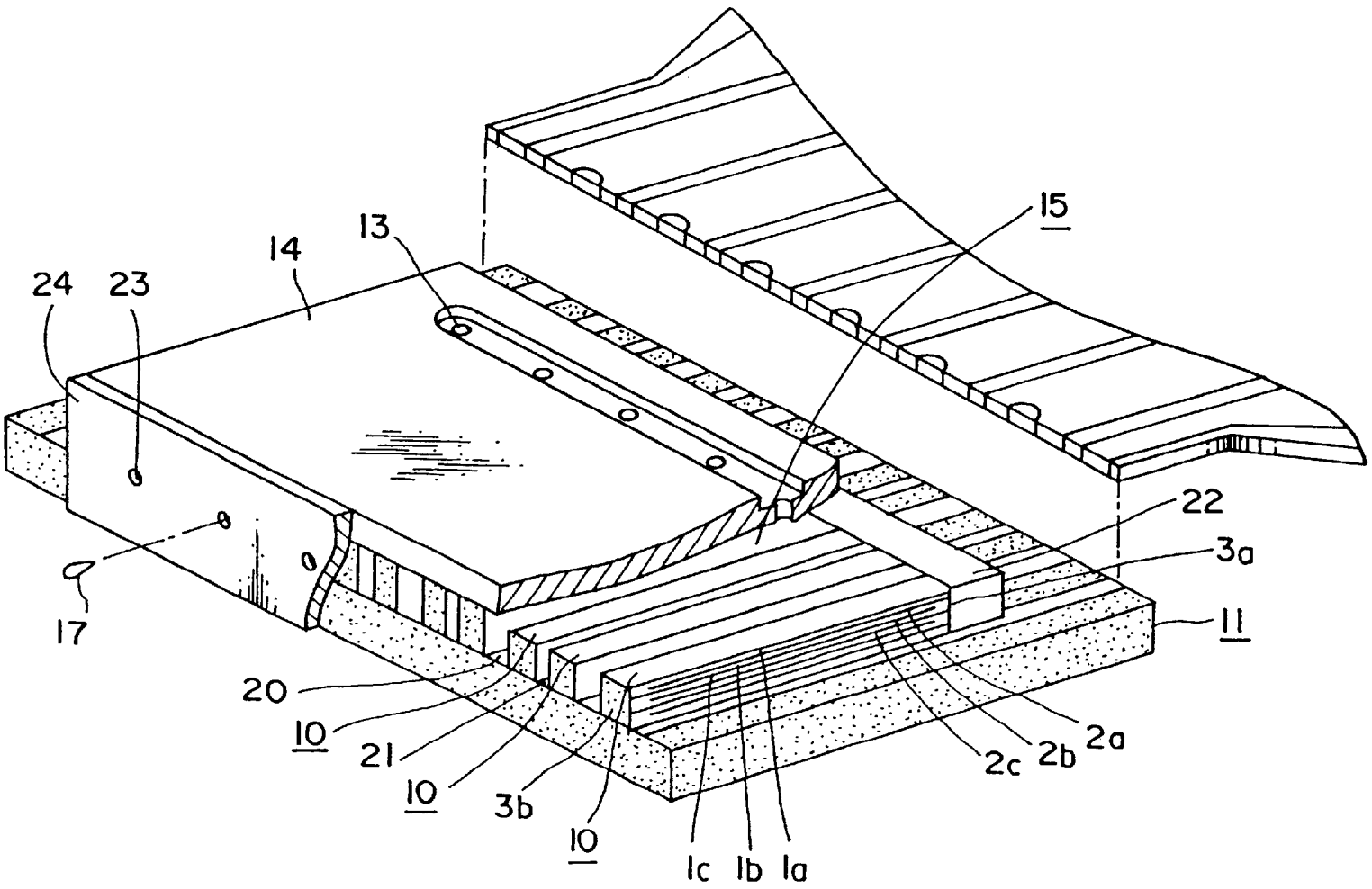
FIG. 16 is a perspective view of an ink-jet head showing a structure thereof according to a seventh embodiment of the present invention.
Figure 17:
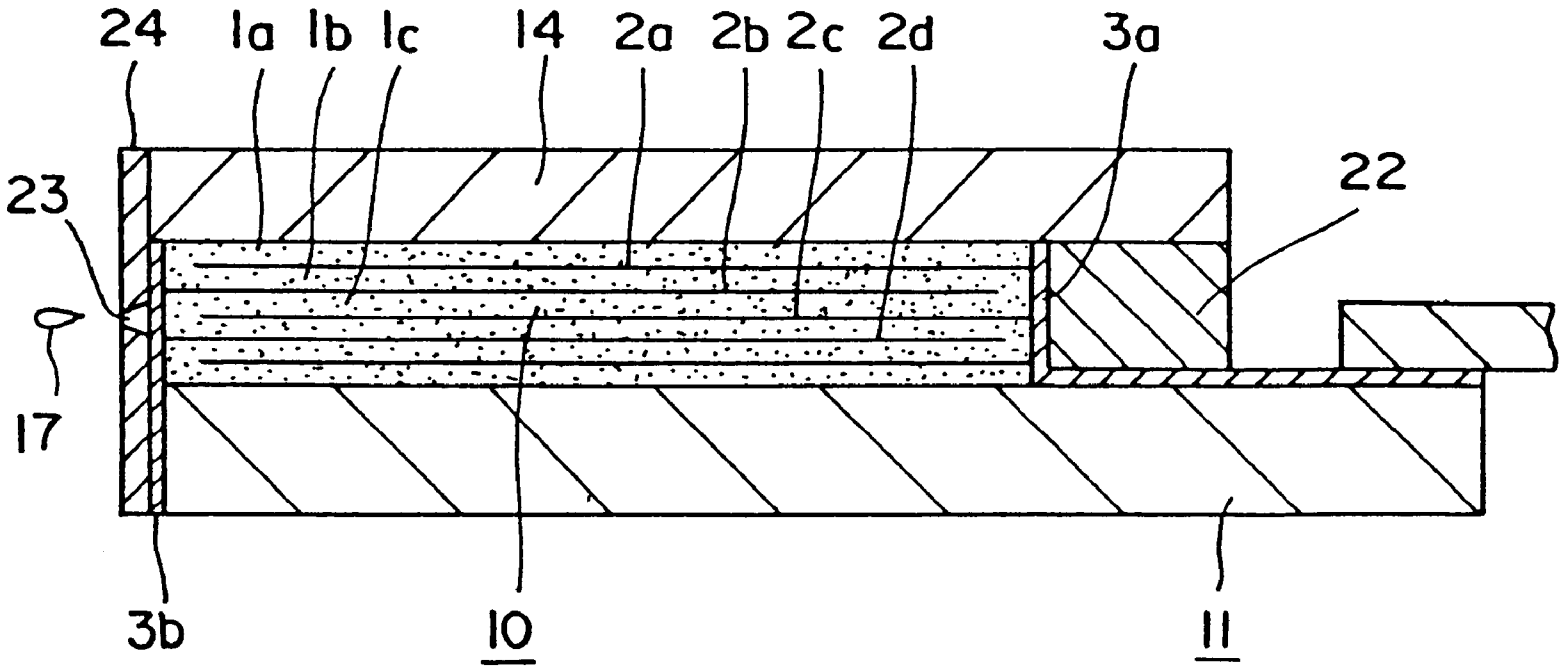
FIG. 17 is a side cross-sectional view of the ink-jet head showing a structure thereof according to the seventh embodiment of the present invention.

An inkjet head according to a seventh embodiment of the present invention is described hereinafter with reference to FIGS. 16 and 17.

A plurality of partitions 10 are arranged in a row on the base plate 11 and bonded thereto.

The partitions 10 are identical in structure to those of the sixth embodiment. That is, a first plate-shaped piezoelectric material layer 1*a* and a second plate-shaped piezoelectric material layer 1*b* are bonded to a first conductive material layer 2*a* interposing therebetween, and further the second plate-shaped piezoelectric material layer 1*b* and a third plate-shaped piezoelectric material layer 1*c* are bonded to a second conductive material layer 2*b* interposing therebetween, thereby constituting a laminated piezoelectric actuator.

Hereupon, the first plate-shaped piezoelectric material layer 1*a* is polarized into the direction of thickness, while the second plate-shaped piezoelectric material layer 1*b* is polarized into the direction opposite to that of the first plate-shaped piezoelectric material layer 1*a*. Further, the third plate-shaped piezoelectric material layer 1*c* is polarized into the direction opposite to that of the second plate-shaped piezoelectric material layer 1*b*.

The first collective electrode 3*a* made of thin gold (Au) film etc. formed by using the thin film forming means such as vacuum evaporation etc. The first conductive material layer 2*a*, etc. are electrically connected to the first collective electrode 3*a*.

On the other hand, the second collective electrode 3*b* is provided at the other end surfaces of the partitions 10 by using a means similar to that of the first collective electrode 3*a*, and the second conductive material layer 2*b*, etc. are electrically connected to the second collective electrode 3*b*.

When voltage is applied between the first collective electrode 3*a* and the second collective electrode 3*b* of an ink-jet head having such a structure, a voltage difference is generated between conductive material layers to generate an electric field in the plate-shaped piezoelectric material layer in the thickness direction thereof. As the result, the partitions 10 function as laminated piezoelectric actuators.

The longitudinal gaps 20 and 21 formed between these partitions 10 are closed at one longitudinal end surface with the sealing member 22. A nozzle plate 24 having nozzle holes 23 therein is provided on the other end surface thereof. The nozzle plate 24 also functions as a sealing member for the longitudinal gaps 20 and 21.

Moreover, the cover 14 is provided to cover the upper portions of the longitudinal gaps 20 and 21. The cover 14 is fixed to the upper surface of the partitions 10 by bonding.

With the above arrangement, the gaps 20 form pressurizing chambers 15. The gaps 21 are the dummy spaces to which no ink is supplied same as to the sixth embodiment set forth above.

The ink supply ports 13 are formed on the cover 14, from which ink is supplied to the pressurizing chambers 15.

In the ink-jet head according to this embodiment, ink supplied to the pressurizing chambers 15 by way of the ink supply ports 13 is ejected in the longitudinal direction of the pressurizing chambers 15 via the nozzle holes 23. It is possible to form an ink droplet 17 stable in size also in this embodiment, same as to the sixth embodiment set forth above.

Figure 18:
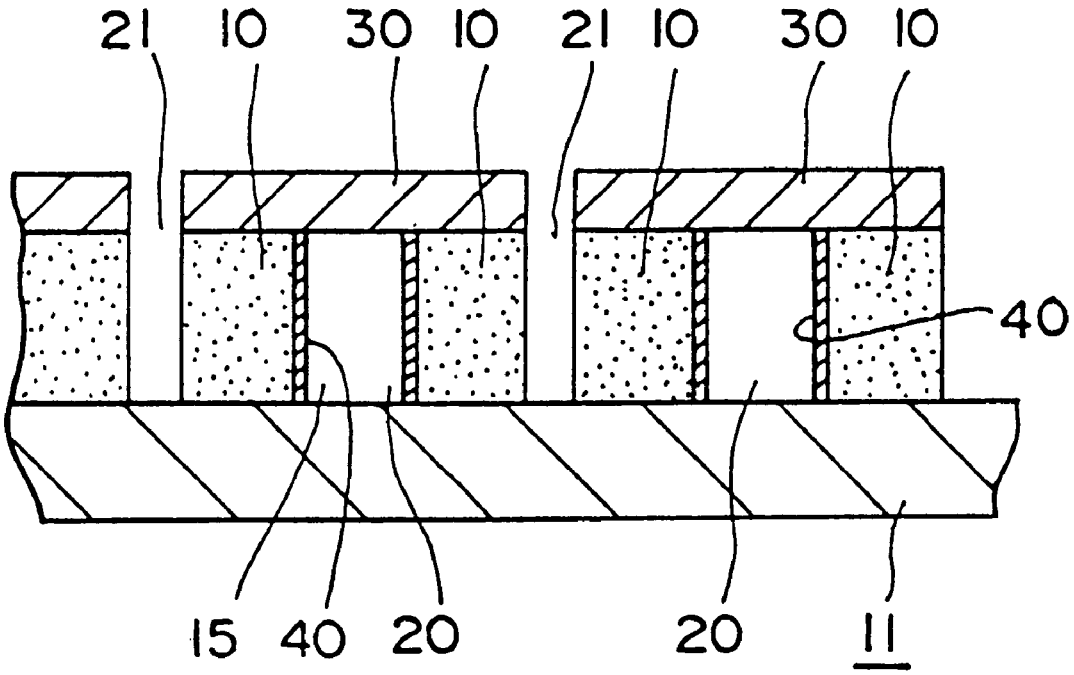
FIG. 18 is a cross-sectional view of the ink-jet head according to amodified example of the sixth and seventh embodiments of the present invention.
Figure 19:
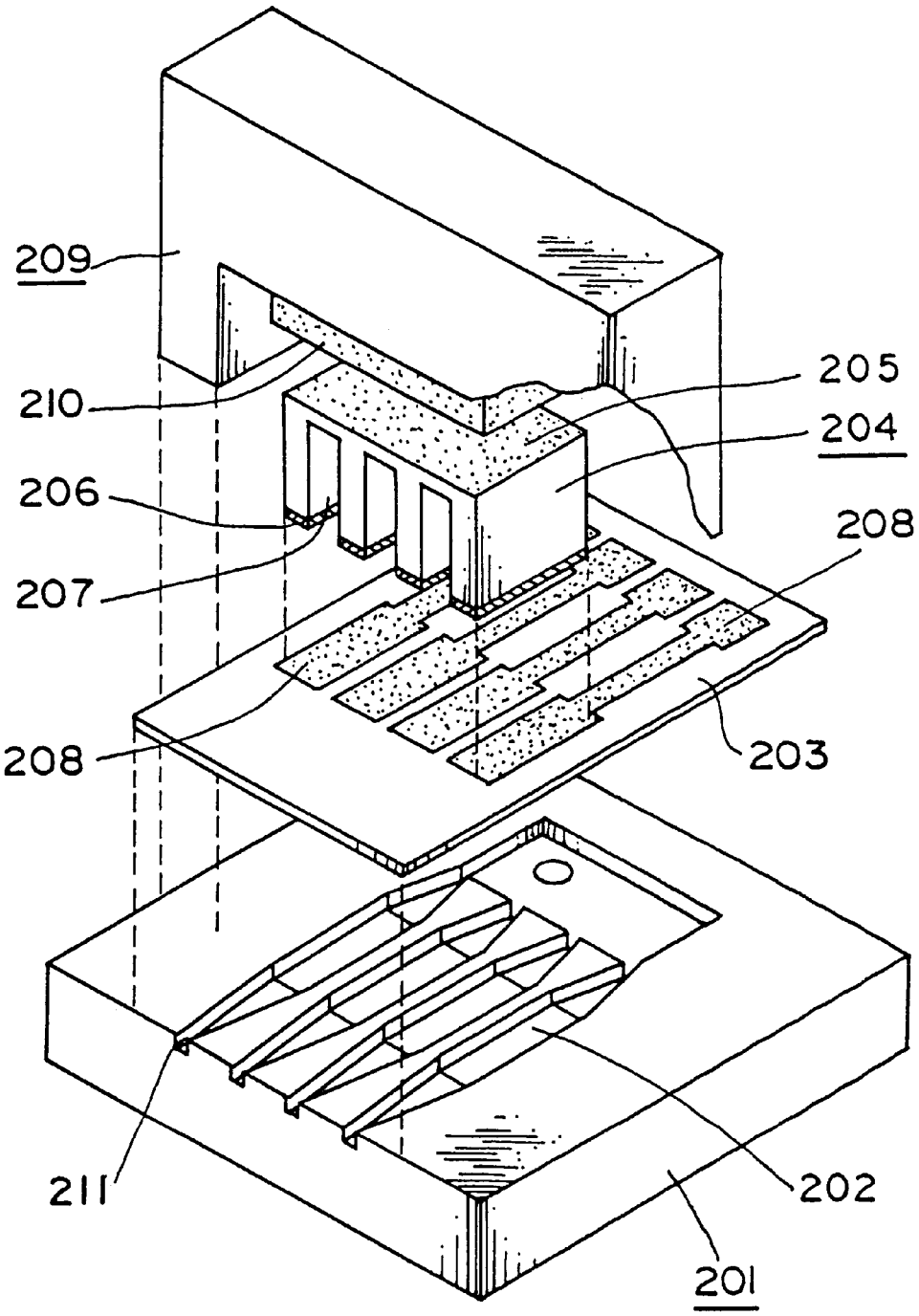
FIG.19 ( PRIOR ART )
FIG. 19 is a perspective view of an ink-jet head showing a structure thereof according to a prior art.
Figure 20:
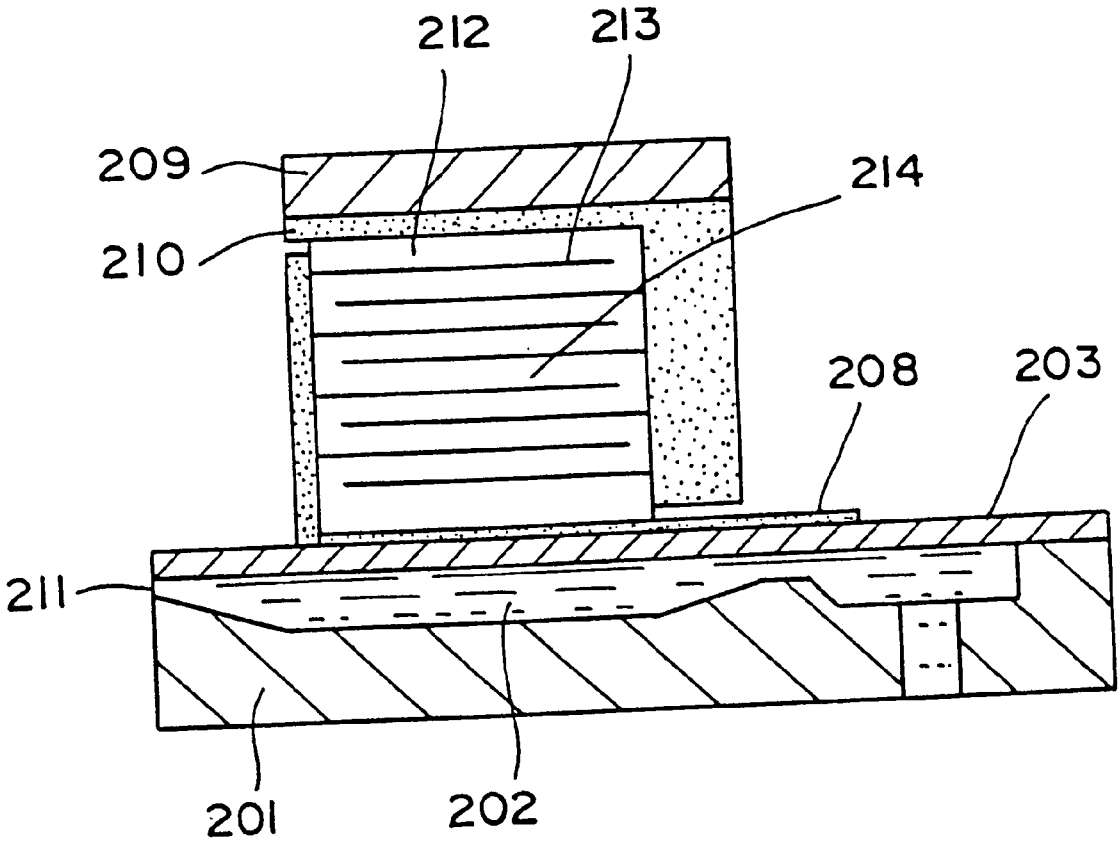
FIG. 20 (PRIOR ART)
FIG. 20 is a cross-sectional view of an ink-jet head showing a structure thereof according to another prior art.
Figure 21:
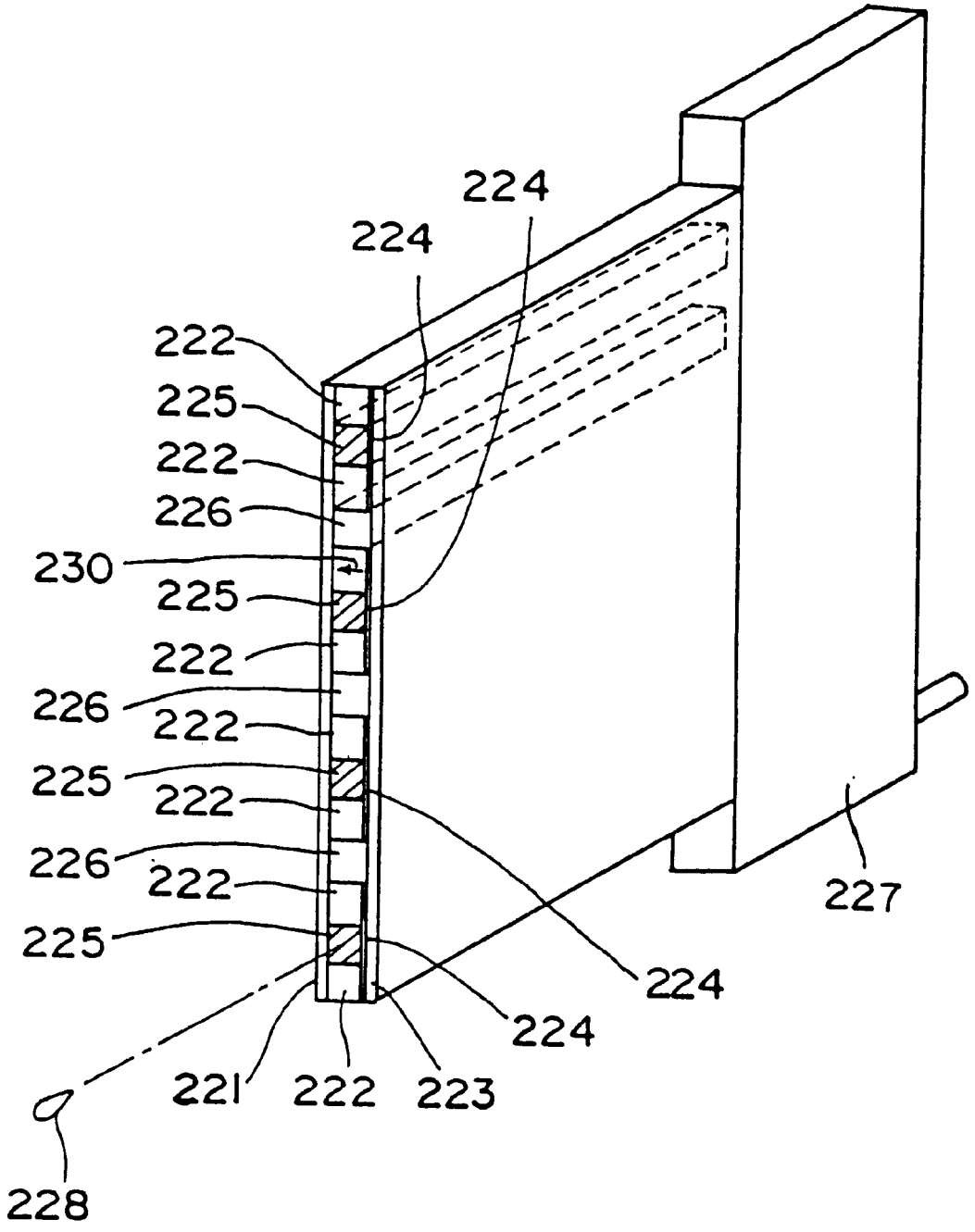
FIG. 21 (PRIOR ART)
FIG. 21 is a perspective view of an ink-jet head showing a structure thereof according to still another prior art.

FIG. 18 is a modified example of the sixth and seventh embodiments set forth above.

That is, in the ink-jet head according to the sixth and seventh embodiments the longitudinal gaps 20 which are filled with ink may be also covered with the independent covers 30.

In the ink-jet head having such a structure, mechanical influence such as the displacement of the partitions 10 for ejecting ink droplets or the transmission of oscillation due to the deformation of the covers 30 does not reach adjacent pressurizing chambers 15. As the result, it is possible to completely prevent the interference between the pressurizing chambers 15.

Furthermore, in the ink-jet head according to the sixth and seventh embodiments set forth above, it is preferable to form an insulative coating film on the inner surface of the pressurizing chambers.

For example, a coating film 40 is formed on the inner surfaces of the partitions 10 which form the pressurizing chambers 15 shown in FIG. 18 due to the chemical evaporation with poly-para-xylene resin, etc.

Driving electrodes electrically connected to conductive material layers are exposed to the inner surfaces of the partitions 10 which form the pressurizing chambers 15. Accordingly, this structure has an inconvenience that available ink is limited, for example, water-soluble ink etc. cannot be used, without additional devices. Therefore, the coating film 40 having the high electrical insulating properties is formed on the partitions 10 inside the pressurizing chamber 15 to prevent ink from contacting the driving electrode.

As the result, a chemical change of ink does not corrode the driving electrode and does not generate gas, so that either the water-soluble or oilsoluble (non-aqueous) ink is applicable.

Moreover, if the piezoelectric element block is formed such that the conductive material is embedded in the partitions 10 in advance which form the pressurizing chambers 15, various kinds of ink can be used without forming the coating film.

INDUSTRIAL UTILIZATION

The ink-jet head according to the present invention can be used in various kinds of ink-jet printers.

The present invention makes it possible to provide a small-sized and high-resolution ink-jet head which can be driven efficiently with little energy loss and be manufactured at low cost because of its simple structure and high reliability.

I claim:

1. A method of manufacturing an ink-jet head for ejecting ink from pressurizing chambers, said ink-jet head comprising a base plate and a laminated piezoelectric actuator unit composed of pairs of laminated piezoelectric actuators each having a piezoelectric strain coefficient $d_{33}$, said laminated piezoelectric actuators having collective electrodes formed on both end surfaces thereof and being arranged in plural rows confronting each other on said base plate, said method comprising:

a first step of forming a first slit at a central portion of a laminated piezoelectric body;

a second step of forming electrodes at side surfaces of both end portions of said laminated piezoelectric body and at said first slit;

a third step of forming a plurality of second slits shallower than said first slit in said laminated piezoelectric body at a given pitch in a direction substantially perpendicular to said first slit to form said plural laminated piezoelectric actuators on said base plate; and a fourth step of grinding upper surfaces of said laminated piezoelectric actuators.

2. A method of manufacturing an ink-jet head for ejecting ink from pressurizing chambers, said ink-jet head comprising a base plate and a laminated piezoelectric actuator unit composed of pairs of laminated piezoelectric actuators each having a piezoelectric strain coefficient $d_{33}$, said laminated piezoelectric actuators having collective electrodes formed on both end surfaces thereof and being arranged in plural rows confronting each other on said base plate, said method comprising:

a first step of forming a first slit at a central portion of a laminated piezoelectric body;

a second step of forming electrodes at side surfaces of both end portions of said laminated piezoelectric body and at said first slit;

a third step of grinding an upper surface of said laminated piezoelectric body; and a fourth step of forming a plurality of second slits shallower than said first slit in said laminated piezoelectric body at a given pitch in a direction substantially perpendicular to said first slit to form said plural laminated piezoelectric actuators on said base plate.

* * * * *